US010684103B2

(12) United States Patent
Whitworth et al.

(10) Patent No.: US 10,684,103 B2
(45) Date of Patent: Jun. 16, 2020

(54) FIREARM CLEANING SHELL

(71) Applicant: Midwest Outdoor Holdings LLC, Commerce Township, MI (US)

(72) Inventors: James Curtis Whitworth, Commerce Township, MI (US); John Biafore, Jr., Grand Blanc, MI (US)

(73) Assignee: Midwest Outdoor Holdings, LLC, Commerce Township, MI (US)

( * ) Notice: Subject to any disclaimer, the term of this patent is extended or adjusted under 35 U.S.C. 154(b) by 0 days.

(21) Appl. No.: 16/226,019

(22) Filed: Dec. 19, 2018

(65) Prior Publication Data

US 2019/0128652 A1 May 2, 2019

Related U.S. Application Data

(63) Continuation-in-part of application No. 15/992,423, filed on May 30, 2018, now Pat. No. 10,302,385, which is a continuation-in-part of application No. 15/340,400, filed on Nov. 1, 2016, now Pat. No. 10,018,455.

(51) Int. Cl.
*F42B 5/24* (2006.01)
*F42B 5/00* (2006.01)

(52) U.S. Cl.
CPC . *F42B 5/24* (2013.01); *F42B 5/00* (2013.01)

(58) Field of Classification Search
CPC .... F42B 14/00; F42B 5/24; F42B 7/00; F42B 99/00; F42B 12/745
USPC .... 102/529, 436, 442, 502, 511, 532; 42/95, 42/106
See application file for complete search history.

(56) References Cited

U.S. PATENT DOCUMENTS 1,495,008 A * 5/1924 Feagin ..... F41A 29/00 102/442
1,830,913 A * 11/1931 Segee ..... F42B 7/04 102/449
2,765,740 A * 10/1956 Norman ..... F42B 5/24 102/442
3,476,047 A * 11/1969 Davis ..... F42B 5/24 102/442
3,762,329 A * 10/1973 Mawhinney ..... F42B 12/34 102/448
3,952,662 A * 4/1976 Greenlees ..... F42B 12/34 102/400
5,225,628 A * 7/1993 Heiny ..... F42B 5/025 102/438

(Continued)

FOREIGN PATENT DOCUMENTS

WO WO-2007059527 A2 * 5/2007 ..... F42B 5/24

*Primary Examiner* — John Cooper
(74) *Attorney, Agent, or Firm* — Quinn IP Law

(57) ABSTRACT

A bore cleaning device is configured to clean a bore of a firearm. The device includes a propellant providing a force to push the projectile down the bore of the firearm, a cup comprising at least one hole in a bottom surface of the cup, a dense material within the cup, wherein the dense material is configured to deform and press radially outwardly against the cup as the propellant provides propelling force to the dense material. The device further includes a bore rearward charge cap and a frame. The frame includes a bore forward plate located within the cup, a frame leg connecting the bore rearward charge cap and the bore forward plate and passing through the hole in the bottom surface of the cup.

14 Claims, 21 Drawing Sheets

(56) References Cited

U.S. PATENT DOCUMENTS

| | | | | | |
|---|---|---|---|---|---|
| 5,777,258 | A * | 7/1998 | Soon | F42B 5/24 | 102/442 |
| 6,164,209 | A * | 12/2000 | Best | F42B 5/307 | 102/439 |
| 6,202,562 | B1 * | 3/2001 | Brunn | F42B 12/34 | 102/293 |
| 7,131,381 | B1 * | 11/2006 | Nafziger | F42B 5/24 | 102/444 |
| 7,150,229 | B2 * | 12/2006 | Gardner | F42B 7/08 | 102/451 |
| 7,743,706 | B1 * | 6/2010 | Lai | F42B 5/24 | 102/442 |
| 9,212,879 | B2 * | 12/2015 | Whitworth | F42B 5/24 | |
| 10,018,455 | B2 * | 7/2018 | Whitworth | F42B 5/24 | |
| 2002/0129725 | A1 * | 9/2002 | Bice | F42B 5/24 | 102/442 |
| 2005/0252405 | A1 * | 11/2005 | Deskins | F42B 5/24 | 102/529 |
| 2014/0109791 | A1 * | 4/2014 | Whitworth | F42B 7/08 | 102/529 |
| 2014/0331886 | A1 * | 11/2014 | Whitworth | F42B 5/24 | 102/529 |
| 2015/0268021 | A1 * | 9/2015 | Whitworth | F42B 5/24 | 102/529 |
| 2016/0258705 | A1 * | 9/2016 | Whitworth | F41A 29/02 | |

* cited by examiner

720

FIREARM CLEANING SHELL

CROSS REFERENCE TO RELATED APPLICATIONS

This disclosure is a continuation-in-part application of U.S. patent application Ser. No. 15/992,423 filed on May 30, 2018 which is a continuation-in-part of U.S. patent application Ser. No. 15/340,400 filed on Nov. 1, 2016, both of which are hereby incorporated by reference.

TECHNICAL FIELD

The present disclosure relates to a device for removing material such as carbon, lead, metals, and plastic contaminants from the bore of a firearm, and more particularly relates to a projectile having a fibrous cup filled with a dense, viscous paste or granulated material, wherein the material within the cup deforms in a radial, outward direction when the projectile is fired down the bore.

BACKGROUND

The statements in this section merely provide background information related to the present disclosure. Accordingly, such statements are not intended to constitute an admission of prior art.

Cleaning the bore of a firearm after use is generally required to prevent possible damage due to corrosion to the bore. It is often true that the task of manually cleaning a firearm is most undesirable when the condition of the firearm is most suitable for bore damage; for example at the end of an outing under inclement conditions. The task of manually cleaning the bore of a firearm is time consuming and may require disassembly of the firearm. Therefore there is a need among users of firearms for a convenient, quick, easily used and effective device for cleaning a bore of moisture, powder residue and foreign material which contributes to the corrosion within a bore until a more complete manual cleaning may be accomplished.

Embodiments are known in the art to propel material down the barrel of a firearm to clean the bore of the gun. These devices, however, rely on compacted wadding to sufficiently wipe down the inner wall of the bore as they travel therethrough. To fit within a shell capable of being fired from a particular firearm inherently requires that the wadding and other materials be compacted to be smaller in rough diameter than the bore they are intended to clean. This results in an ineffectively cleaning of the bore as portions of the bore are not wiped by the intended cleaning components.

Further, these devices also generally comprise stacked layers of wadding and other materials which are either pre-moistened with a cleaner or lubricant which reduces the shelf life of product.

SUMMARY

A bore cleaning device is configured to clean a bore of a firearm. The device includes a propellant providing a force to push the projectile down the bore of the firearm, a cup comprising at least one hole in a bottom surface of the cup, a dense material within the cup, wherein the dense material is configured to deform and press radially outwardly against the cup as the propellant provides propelling force to the dense material. The device further includes a bore rearward charge cap and a frame. The frame includes a bore forward plate located within the cup, a frame leg connecting the bore rearward charge cap and the bore forward plate and passing through the hole in the bottom surface of the cup.

BRIEF DESCRIPTION OF THE DRAWINGS

One or more embodiments will now be described, by way of example, with reference to the accompanying drawings, in which:

FIG. 9 illustrates bore cleaning device situated within a bore of a firearm in an unfired state;

FIG. 10 illustrates the bore cleaning device of FIG. 9 shortly after the device is transitioned to the fired state, with the metallic paste beginning to deform and press outwardly upon the cup;

FIG. 11 illustrates the bore cleaning device of FIG. 10 at some later point further down the bore;

DETAILED DESCRIPTION

Figure 1:
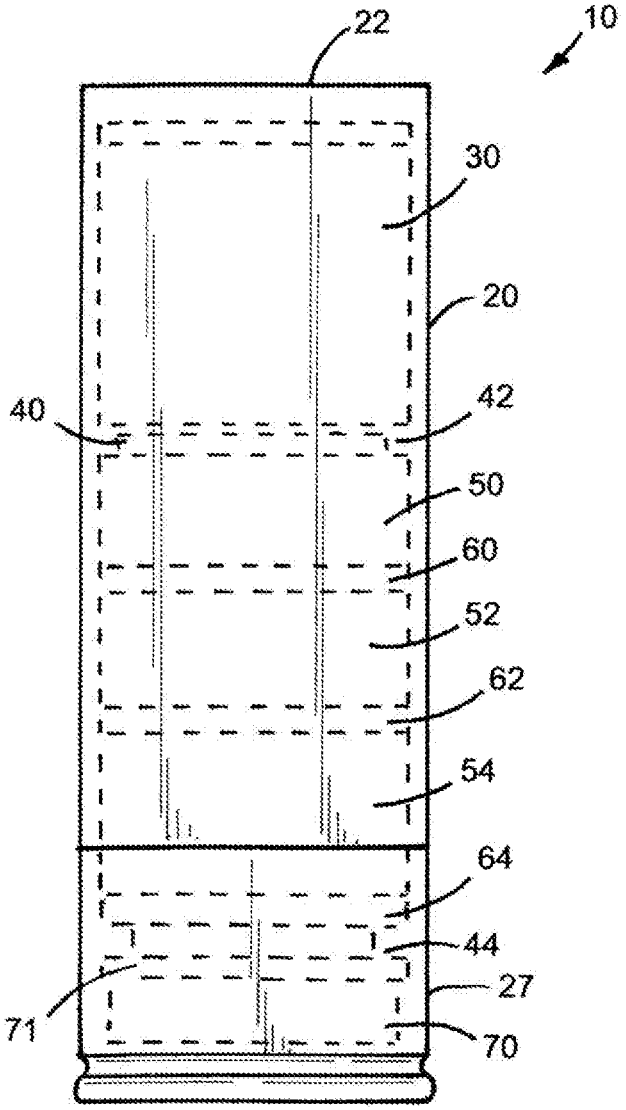
FIG. 1 illustrates an exemplary bore cleaning device in side view, in accordance with the present disclosure.

An improved bore cleaning device is disclosed, including a frame and a fibrous cup situated in a bore-forward position to the frame, wherein the fibrous cup is filled with one of a dense granular material and a dense, viscous paste/viscous liquid material or both a dense granular material and viscous paste or liquid. In a bore-rearward direction to the frame, a propellant, once ignited, provides a sudden and dramatic propelling force to the frame, which, in turn, provides a similarly dramatic force to the cup located at the bore-forward position. The dense material in the cup, being one of a dense granular material and/or a dense viscous material, upon receiving the sudden and dramatic force, tends to flatten out. As a result of the initially stationary dense material tending to stay at rest, the accelerative force applied to the dense material causes the dense material to flow in a bore-rearward direction, thereby providing a radially outward force, pushing the fibrous material into intimate contact with the inside surfaces of the bore. This intimate contact between the fibrous cup and the inside surfaces of the bore, as the cup is being forced down the bore, wipes the inside surface of the bore, with contaminants being loosened and swept along the bore with the fibrous cup.

The fibrous cup can be used in isolation of other cleaning surfaces on the projectile, with the cup being the only cleaning surface in contact with the inside of the bore. In another embodiment, the frame can include additional cleaning features that continue to wipe the inside surface of the bore as the frame follows the fibrous cup down the bore. In one exemplary construction, the frame can include a disk at one terminal end of the frame, another disk at the other terminal end of the frame, and legs connected between the disks, wherein the legs are configured to bend when a propulsive force is applied to one of the disks. By wrapping or placing cleaning materials, such as scrubbing or wiping materials, around the legs that are configured to bend, the bending legs can include an outward/radial displacement that forces intimate contact between the cleaning materials and the inside of the bore.

Cleaning materials that can be wrapped or placed around the bending legs can include disk or cylinder shaped cleaning materials. One exemplary scrubbing material can be a fibrous pad rigid enough to hold its form when no propelling force is acting upon the scrubbing material and yet pliable enough to expand outwardly/radially by an exemplary 1-8 mm when acted upon by the bending legs.

A disk shaped or cylindrically shaped scrubbing pad can have a hole in the center for the bending legs, in an unbent or resting state, to be inserted therethrough in an assembly process for the projectile. In another embodiment, the scrubbing pad can additionally include a longitudinal slot, so that the scrubbing pad can be fitted through the slot over the bending legs. In one embodiment, the scrubbing material can be formed with an outer shape of a cylinder. In one embodiment, wherein the projectile is configured for use in a firearm having a rifled barrel, a plurality of longitudinal slots or notches can be cut in the outer surface of the cylindrical shape. These outwardly facing slots or notches form small corners in the material, permitting the scrubbing pad material in the small corners to penetrate into recesses in the rifling that would normally not be reached by a cylindrical pad without the notches or slots.

Referring now to the drawings, wherein the showings are for the purpose of illustrating certain exemplary embodiments only and not for the purpose of limiting the same, FIG. 1 illustrates an exemplary bore cleaning device in side view. Bore cleaning device 10 includes shell case 20 and brass head or casing 27. Bore cleaning device 10 includes an exemplary device configured to imitate a shotgun shell and clean the bore of a shotgun, which can include a smooth bore (for example, used with bird shot) or a rifled bore (for example, used with a rifled deer slug.) It will be appreciated that a similar device using embodiments of the disclosed device can be configured for use in an exemplary 9 mm handgun or an exemplary .223 caliber rifle, and the disclosure is not intended to be limited to the particular shotgun configuration in the illustrated embodiments. Viewed from the outside, device 10 including shell case 20 and brass head 27 can look very similar to a shotgun shell of the same caliber as ammunition for the same firearm to be cleaned. In another embodiment, shell case 20 can be transparent or translucent, both for aesthetic or marketing purposes and/or to prevent a user from confusing the bore cleaning device with live ammunition.

Internal components of bore cleaning device 10 are illustrated with dotted lines. Shell case end portion 22 includes material of shell case 20 pressed into an end similar to ends of ammunition rounds, the end portion 22 holding the components of device 10 within shell case 20 until the device is fired or activated within a firearm. Components of the device include fibrous cup 30, frame 40, cleaning materials 50, 52, 54, 60, 62, and 64, and propellant 70. Frame 40 includes a first disk 42, a second disk 44 longitudinally containing the cleaning materials therebetween.

Figure 2:
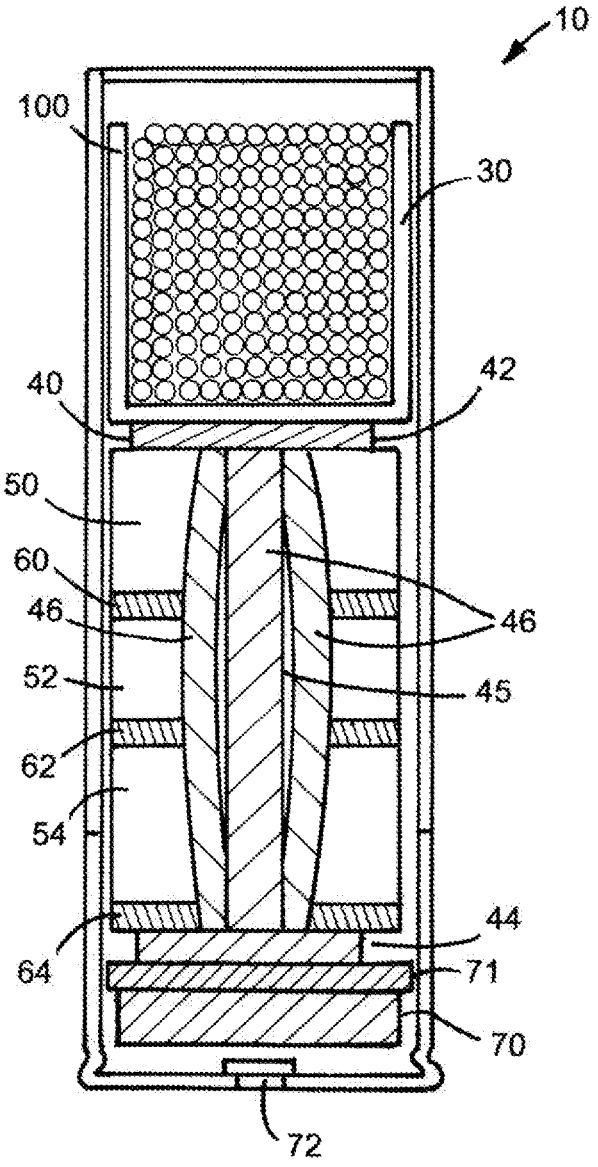
FIG. 2 illustrates the bore cleaning device of FIG. 1 in cross-section, in accordance with the present disclosure.

FIG. 2 illustrates the bore cleaning device of FIG. 1 in cross-section. Bore cleaning device 10 includes fibrous cup 30 filled with dense, granular material, frame 40, cleaning materials 50, 52, 54, 60, 62, and 64, gas seal 71, propellant 70, and primer 72. Primer 72 is configured to provide a spark to propellant 70 when the primer is struck by a firing pin. Propellant 70 can include gunpowder, although some types of gunpowder are not ideal as they can introduce contaminants to the inside of the bore as the device is propelled through the bore. Propellant 70 can include chemical compositions known in the art configured to rapidly or explosively expand as a spark is introduced.

Fibrous cup 30 is a cup constructed of fibrous material. The material can include fibrous paper, recycled material, high temperature resistant material (capable of withstanding excess of 400 degrees F. or 200 degrees C.) and/or a durable/flexible tapered cup. The material can be selected to avoid condensation within the device. Cup 30 is filled with a dense granular and/or dense viscous material. Exemplary dense materials can include but are not limited to lead, zinc, iron, copper, colloidal suspensions, and metallic or ceramic pastes. Dense materials useful for the disclosed device ideally deforms as the device 10 transitions from an unfired state in the chamber of a firearm to a fired state speeding down the bore of the firearm. This deformation is created by the inertial forces inherent to the dense material. The dense material needs to deform in a rearward bore direction in relation to the cup, such that the deforming material pushes in a radially outward direction, pushing the fibrous cup against the inner surface of the bore of the firearm. This radially outward force against the cup forces the fibrous material of the cup to create intimate contact with the bore, such that the fibrous material scrubs and loosens debris from the inner surface of the bore.

Cup 30 of FIG. 2 is filled with exemplary lead spheres 100, each roughly 0.8-1.5 mm thick. Spheres of this size enable the spheres 100 to move easily against each other such that the required deformation is achieved. Larger spheres would fail to flow against each other and would act more like a solid weight in cup 30, which would fail to cause intimate contact between the cup and the bore. Smaller spheres would tend to displace within the device, falling out of the cup and down the sides of the device, thereby making spheres 100 ineffective for the required deformation and outward force upon cup 30.

Device 10 can include a rigid frame that is primarily configured to transfer force from expanding propellant 70 to cup 30. In the embodiment of FIG. 2, frame 40 includes a first disk 42, a second disk 44, and four legs 46 connecting the two disks 42 and 44. Legs 46 are defined by open slot 45 between the legs. Legs 46 are configured such that when the propellant provides a strong propelling force upon disk 44, the frame 40 is compressed and legs 46. As legs 46, they extend sideways or in a radially outward direction in relation to the inside surface of a bore of a firearm. Cleaning materials 50, 52, 54, 60, 62, and 64 are wrapped or positioned around legs 46. As legs 46 bend and push radially outward, the cleaning materials are pushed against the inside surface of the bore of the gun. When second disk 44 is narrower than the bore of the firearm to be cleaned, a charge plug 71 can be added to seal behind the frame 40 and provide a surface for the force of the propellant to push against. In one embodiment, two legs 46 are formed with disk 42, and two legs are formed with disk 44, and the disks each include small cavities configured to receive small snapping features on the ends of the legs of the other disk.

Figure 3:
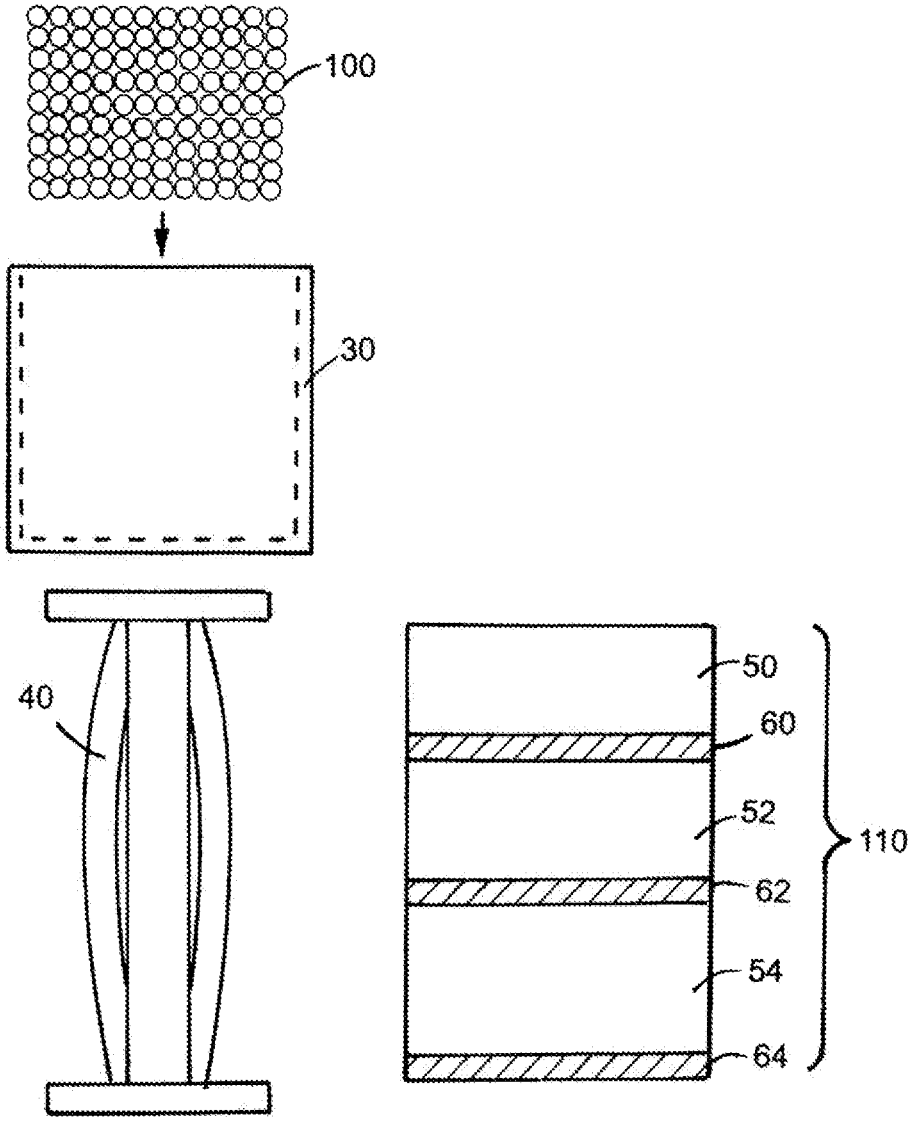
FIG. 3 illustrates the components of the bore device of FIG. 2 removed from the shell case, in accordance with the present disclosure.

FIG. 3 illustrates the components of the bore device of FIG. 2 removed from the shell case. Lead spheres 100 are illustrated ready to be provided within cup 30. Frame 40 is illustrated, with cleaning materials 110 including fibrous cylindrically shaped pads 50, 52, and 54 and rubberized wiper disks 60, 62, and 64 removed from frame 40.

Figure 4:
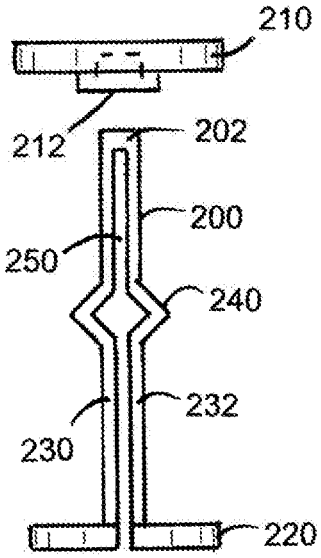
FIG. 4 illustrates an alternative frame to the frame of FIG. 3, in accordance with the present disclosure.

FIG. 4 illustrates an alternative frame to the frame of FIG. 3. Frame 200 is illustrated including frame body 201 and a separable forward disk 210. Frame body 201 includes rearward disk 220 and bending legs 230 and 232. Bending legs 230 and 232 are defined by slot 250 therebetween and knee portions 240. Frame body 201 include forward end 202 configured to be inserted within receiving cavity 212 of forward disk 210. With forward disk 210 installed to frame body 201, frame 200 functions similarly or identically to frame 40 of FIG. 3. Rearward disk 220 can be a solid round disk. In the exemplary embodiment of FIG. 4, rearward disk 220 can be segmented in two half circles, such that the split between the two half circles helps the connected legs 230 and 232 to widen more easily when the propelling force is applied.

Figure 5:
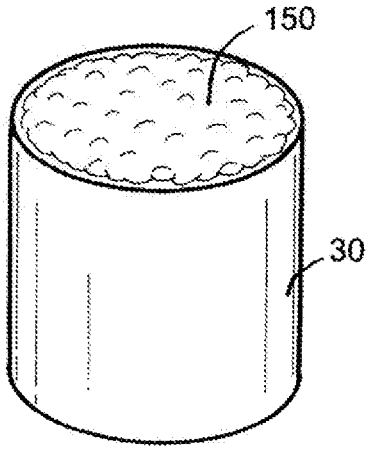
FIG. 5 illustrates a fibrous cup filled with an exemplary alternative dense material, such as a metallic paste, in accordance with the present disclosure.

FIG. 5 illustrates a fibrous cup filled with an exemplary alternative dense material, such as a metallic paste. Cup 30 is filled with a metallic paste which is dense, with a similar density to lead or a similar material. The paste is viscous, meaning that it includes a flow resistance, but it is not so viscous that it will not deform when fired down the bore of a firearm.

Figure 6:
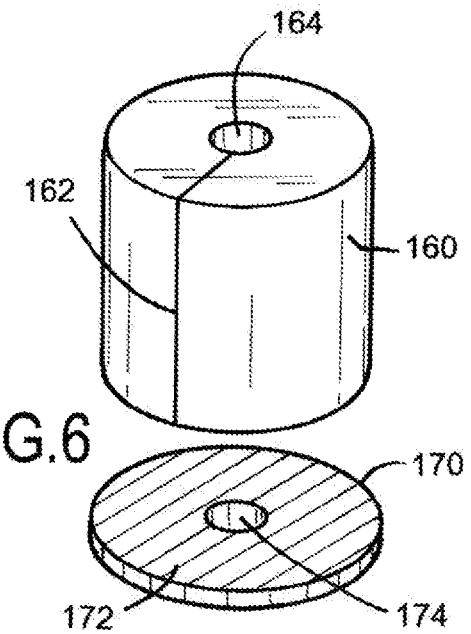
FIG. 6 illustrates exemplary cleaning materials including slots cut from a center hole to an outer surface and configured to be installed to bending legs of a frame, in accordance with the present disclosure.

FIG. 6 illustrates exemplary cleaning materials including slots cut from a center hole to an outer surface and configured to be installed to bending legs of a frame. Fibrous pad 160 is formed in the shape of a cylinder. Pad 160 includes center hole 164 and slot 162 connecting center hole 164 to an outside surface of pad 160. Rubberized wiper disk 170 is illustrated including center hole 174 and slot 172 connecting center hole 174 to an outside surface of wiper 170. Slots 162 and 172 are configured such that pad 160 and wiper 170, respectively, can be slid over bending legs of a frame.

Figure 8:
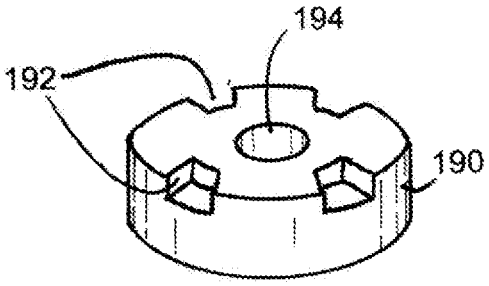
FIG. 8 illustrates a fibrous pad including notches cut in an outer surface of the pad to facilitate cleaning of a rifled bore, in accordance with the present disclosure.
Figure 7:
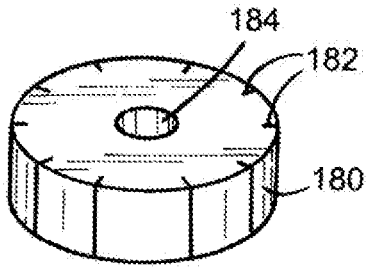
FIG. 7 illustrates a fibrous pad including slots cut in an outer surface of the pad to facilitate cleaning of a rifled bore, in accordance with the present disclosure.

FIG. 7 illustrates a fibrous pad including slots cut in an outer surface of the pad to facilitate cleaning of a rifled bore. Fibrous pad 180 includes center hole 184. Slots 182 are illustrated around a perimeter of pad 180 but do not cut all the way through the material of pad 180, such that the pad remains intact. FIG. 8 illustrates a fibrous pad including notches cut in an outer surface of the pad to facilitate cleaning of a rifled bore. Fibrous pad 190 includes center hole 194. Notches 192 are illustrated around a perimeter of pad 190 but do cut all the way through the material of pad 180, such that the pad remains intact.

Figure 9:
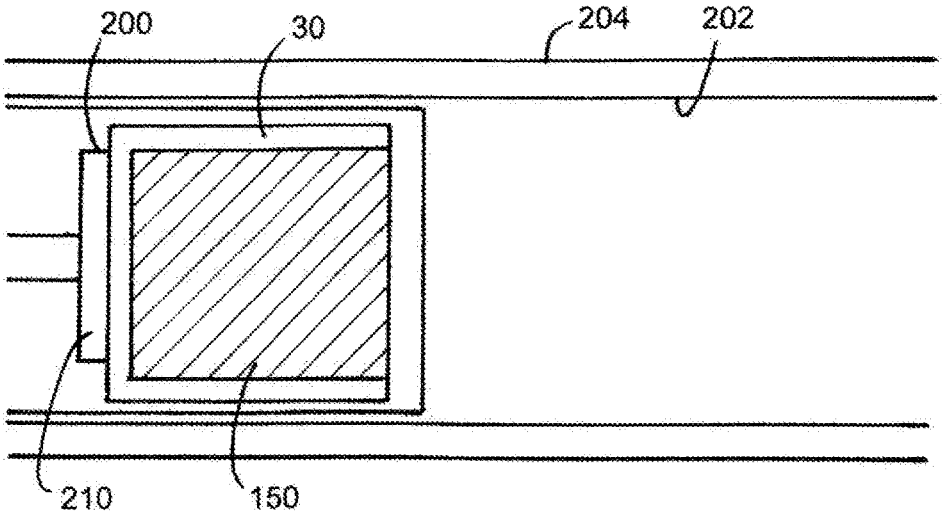
FIGS. 9-11 are illustrated in cross-section, showing a bore cleaning device being propelled down the bore of a firearm, in accordance with the present disclosure.
Figure 10:
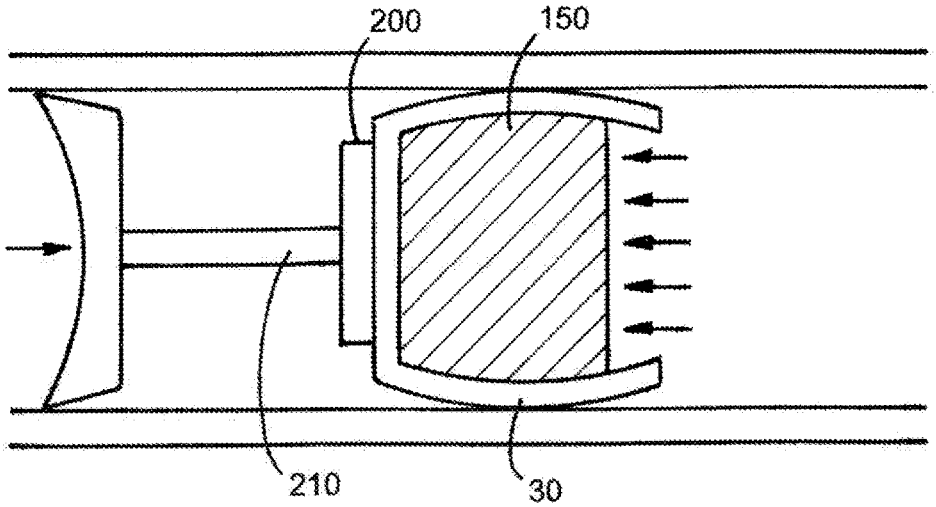
Figure 11:
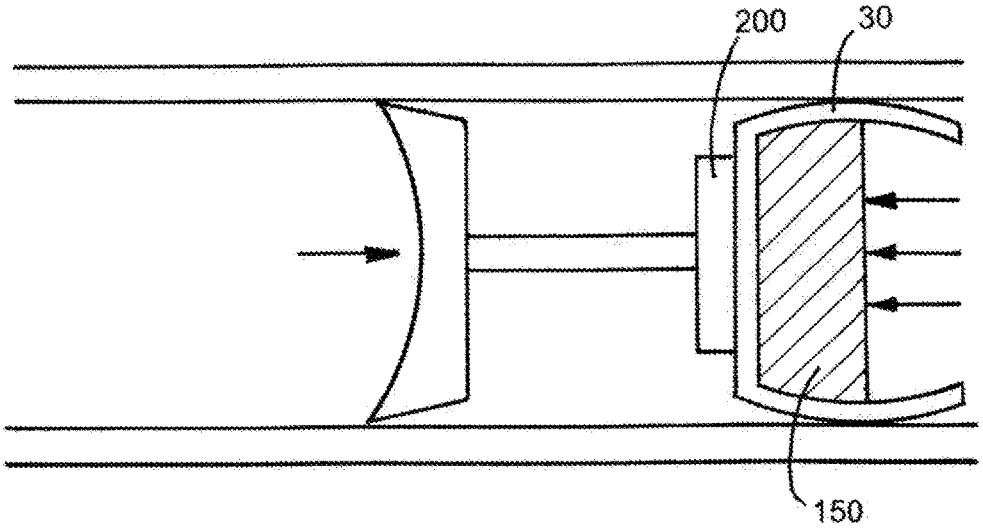

FIGS. 9-11 are illustrated in cross-section, showing a bore cleaning device being propelled down the bore of a firearm. FIG. 9 illustrates bore cleaning device 200 situated within bore 202 of firearm 204 in an unfired state. Device 200 includes rigid frame 210, cup 30, and metallic paste 150 within cup 30. FIG. 10 illustrates the bore cleaning device of FIG. 9 shortly after the device is transitioned to the fired state, with the metallic paste beginning to deform and press outwardly upon the cup. Bore cleaning device 200 includes rigid frame 210 and cup 30 filled with metallic paste 150. Very rapid acceleration of device 200 down bore 202 deforms paste 150 such that surface 152 of paste 150 moves in a bore rearward direction in relation to cup 30. This rearward deformation of paste 150 forces the paste to push radially outwardly against cup 30, such that cup 30 is pressed against bore 202. FIG. 11 illustrates the bore cleaning device of FIG. 10 at some later point further down the bore. As the bore cleaning device 200 continues to accelerate down bore 202, paste 150 continues to deform, surface 152 continues to move in a bore rearward direction relative to cup 30, and paste 150 continues to create an outward force, pushing cup 30 against bore 202.

Figure 12:
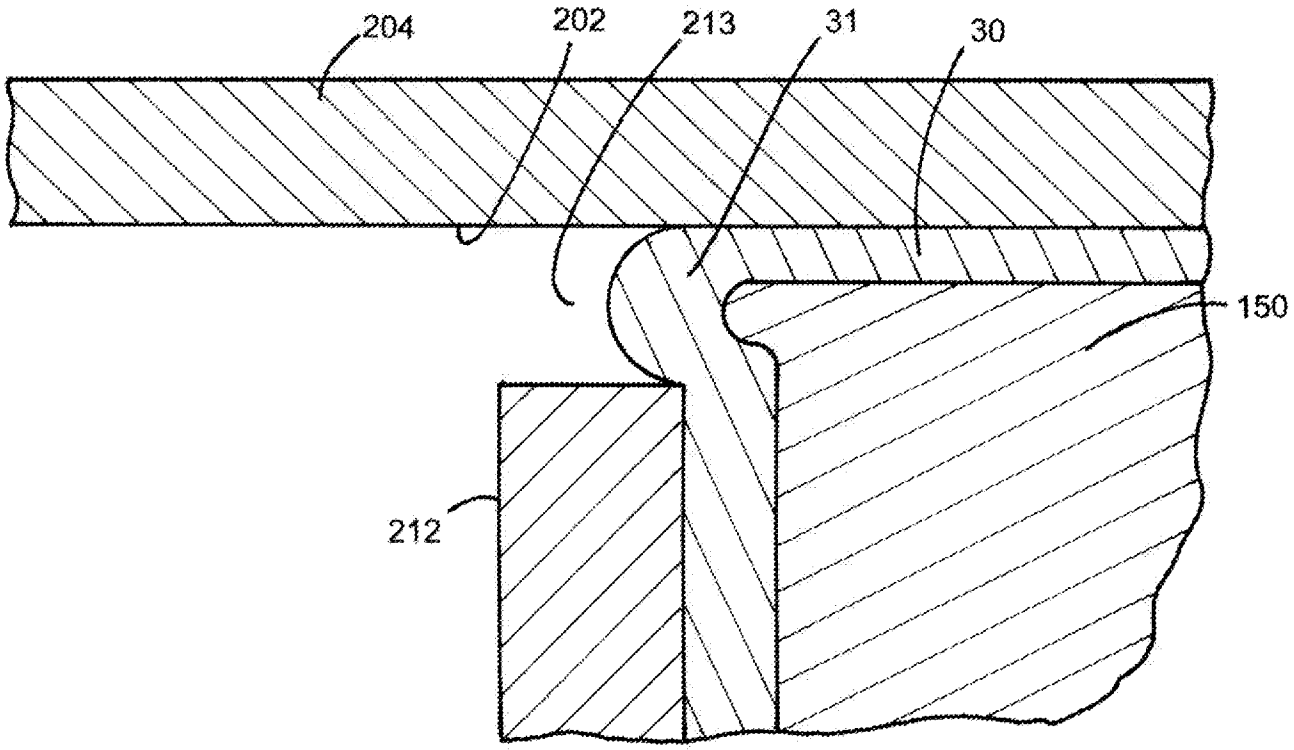
FIG. 12 illustrates an optional construction including interaction between the cup and the frame of FIG. 11 with increased scale, showing an exemplary frame including a narrow bore forward disk enabling the cup to bend backward into a gap between the disk and the surface of the bore, in accordance with the present disclosure.

FIG. 12 illustrates an optional construction including interaction between the cup and the frame of FIG. 11 with increased scale, showing an exemplary frame including a narrow bore forward disk enabling the cup to bend backward into a gap between the disk and the surface of the bore. Firearm 204 is illustrated including bore 202. Bore forward disk 212 of frame 210 of FIG. 11 is illustrated, wherein the disk is narrower in diameter than the diameter of bore 202. As a result, gap 213 exists between the surface of bore 202 and disk 212. Dense paste 150 is contained within fibrous cup 30. As the device moves down bore 202, the dense paste 150 pushes material of the fibrous cup 30 into a curved backward portion 31. It will be appreciated that by permitting portion 31 to curve backward into gap 213, the gap being created by using a bore forward disk with a diameter substantially less than the bore of the firearm, the scrubbing force applied by cup 30 against the surface of bore 202 can be increased.

Frames for the present device can be constructed of many different materials, including but not limited to polyethylene and other common plastics.

Figure 13:
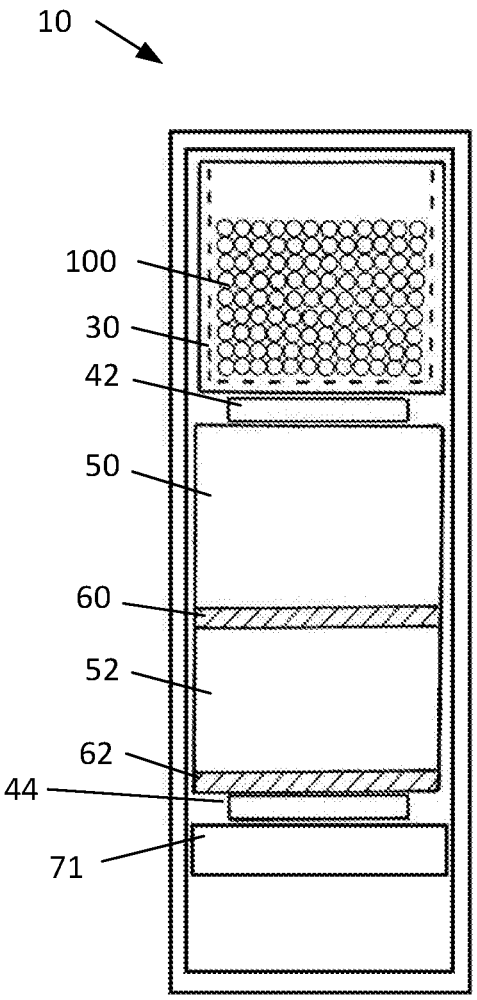
FIG. 13 illustrates an alternative exemplary embodiment of the bore cleaning device of FIG. 1 in side view, in accordance with the present disclosure.

FIG. 13 illustrates an alternative exemplary embodiment of the bore cleaning device of FIG. 1 in side view. Device 10 includes a shell case. Components of the device include fibrous cup 30, cleaning materials 50, 52, 60, and 62. A first bore forward disk 42, a second bore rearward disk 44, and a gas seal 71 are illustrated. Cup 30 is filled with exemplary spheres 100.

Figure 14:
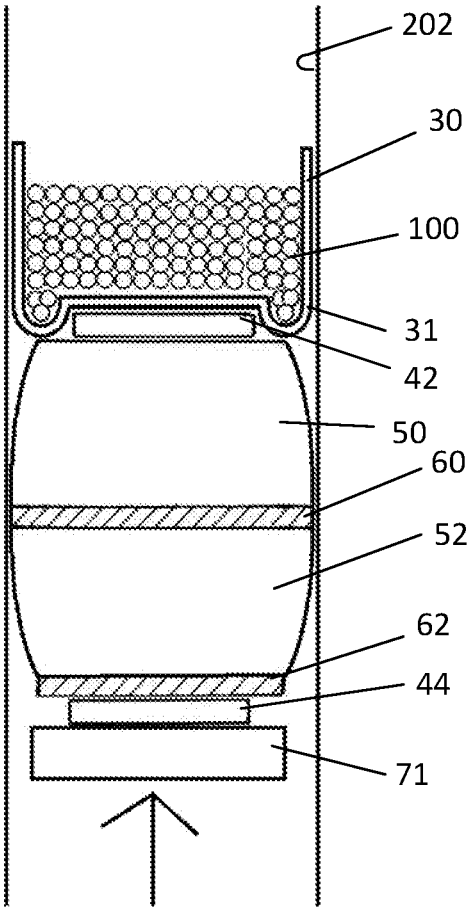
FIG. 14 illustrates the embodiment of FIG. 13 being propelled down the bore of a firearm, with compressive force causing the device to expand radially outwardly against the bore, in accordance with the present disclosure.

FIG. 14 illustrates the embodiment of FIG. 13 being propelled down the bore of a firearm, with compressive force causing the device to expand radially outwardly against the bore. Bore 202 is illustrated. The device of FIG. 13 is illustrated, having exited the illustrated shell case and being propelled by gas pressure acting upon a bottom surface of gas seal 71. Force applied to gas seal 71, pushing upwardly through disk 44, both crushes and pushes radially outward cleaning materials 50, 52, 60, and 62 and collapses cup 30 such that curved backward portion 31 of cup 30 forms around a diameter of disk 42.

Figure 15:
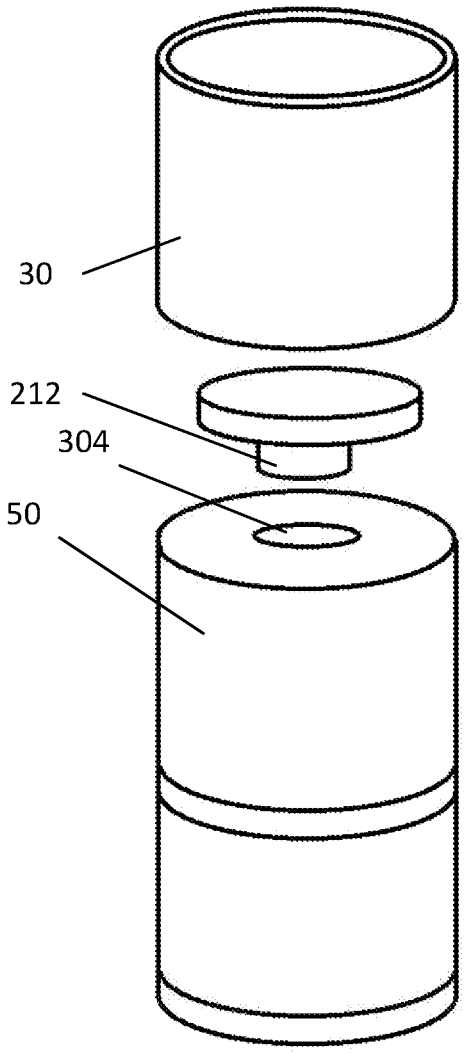
FIG. 15 illustrates components of the embodiment of FIG. 13 in an side expanded view, in accordance with the present disclosure.

FIG. 15 illustrates components of the embodiment of FIG. 13 in a side expanded view. Cup 30, forward disk 210 including a thin neck portion 214, and cleaning materials including cleaning material 50. Cleaning material 50 includes a cylinder-shape including a hollow center portion 304. Neck portion 214 is configured to be inserted within hollow center portion 304.

Figure 16:
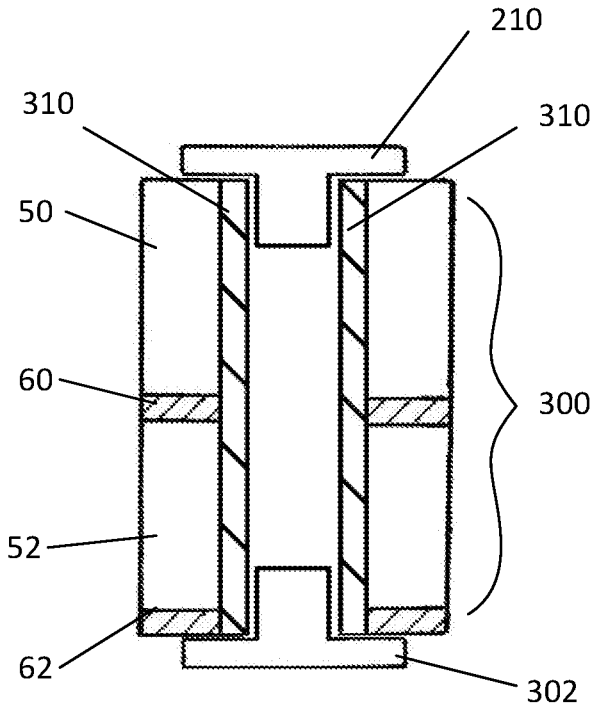
FIG. 16 illustrates one embodiment of the stack of cleaning materials in the embodiment of FIG. 15, with adhesive or a stiffening agent being applied to some portion of the stack, in accordance with the present disclosure.

A number of different embodiments of stacks of cleaning materials and disks can be used to transmit force longitudinally through the device and provide a crushing force to expand the cleaning materials radially outwardly. FIG. 16 illustrates one embodiment of the stack of cleaning materials in the embodiment of FIG. 15, with a hardened adhesive or a stiffening agent being applied to some portion of the stack. Cleaning materials 50, 60, 52 and 62 are illustrated collectively as cleaning material stack 300. An internal surface 310 of stack 300, the surface along the hollow internal portion of the stack, has been treated with an adhesive or other stiffening agent. This stiffening agent upon surface 310 enables force to be transmitted through the relatively soft cleaning materials of stack 300 between disk 302 and disk 210. In one embodiment, a portion such as surface 310 can be treated with such a stiffening agent. In another embodiment, the entirely of stack 300 can be treated with a stiffening agent.

Figure 17:
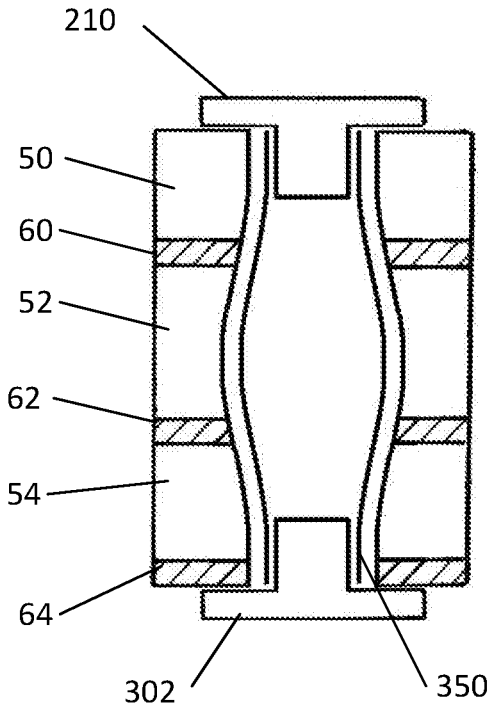
FIG. 17 illustrates a second embodiment of the stack of cleaning materials in the embodiment of FIG. 15, with an exemplary collapsing plunger unit spanning between a bore forward disk and a bore rearward disk, in accordance with the present disclosure.

FIG. 17 illustrates in cross sectional view a second embodiment of the stack of cleaning materials in the embodiment of FIG. 15, with an exemplary collapsing plunger unit spanning between a bore forward disk and a bore rearward disk. Disk 210 and disk 302 are illustrated, with a plurality of cleaning materials 50, 52, 54, 60, 62, and 64 being illustrated in between. An exemplary thin plastic collapsing plunger unit 250 is illustrated between disks 210 and 302, with some portion of a longitudinal force being transmitted between disks 210 and 302 through plunger unit 350 and with another portion of the longitudinal force being transmitted through the stack of cleaning materials 50, 52, 54, 60, 62, and 64. Space is shown between plunger unit 350 and surrounding materials for illustration clarity. It will be appreciated that the various components can be configured to be in close contact with each other within the device.

Cleaning materials 60, 62, and 64 are exemplary washers or wipers configured to wipe along the inside of the bore. These wipers can be made of any of a number of materials including but not limited to fibrous materials, neoprene, and compressed paper.

Figure 18:
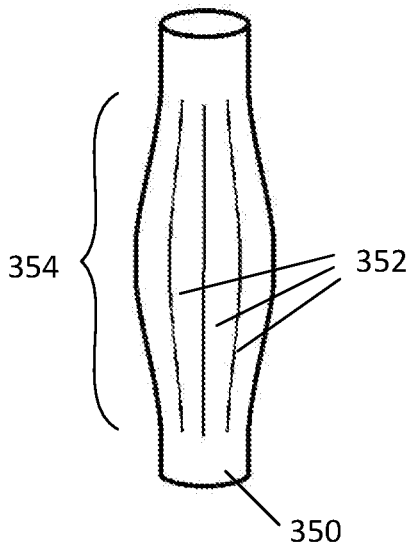
FIG. 18 illustrates the collapsing plunger unit of FIG. 17 in detail, in accordance with the present disclosure.

FIG. 18 illustrates the collapsing plunger unit of FIG. 17 in detail. In one exemplary construction, plunger unit 350 can be made of a polyethylene or similar material with uniform thickness walls. Slots 352 are illustrated cut or formed into plunger unit 350, such that when a compressive force is applied to the ends of plunger unit 350, the material between slots 352 can bow outwardly, thereby putting outward radial pressure on cleaning materials that are situated around the plunger unit 350. In one embodiment, a central portion 354 is formed bulged outward, such that when the force is applied to the ends of plunger unit 350, the material between slots 352 can only bow outwardly. In another embodiment, plunger unit 350 can alternatively be a cylindrically shaped unit with straight walls.

It will be appreciates the cylindrically shaped stack of cleaning materials in either FIGS. 16 and 17 are configured to press against the bore forward disk and provide at least a portion of the force being transmitted through the device to the bore forward disk.

Figure 19:
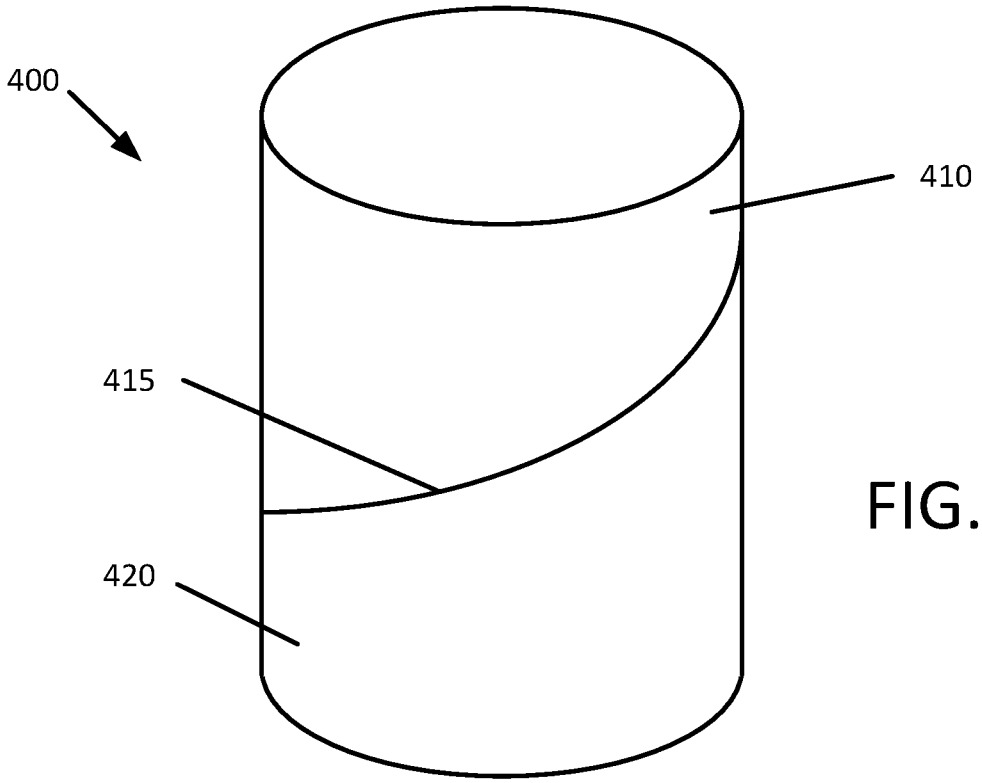
FIG. 19 illustrates in perspective view an alternative embodiment for a stack of cleaning materials, with two opposing slant-cut fibrous wads being configured to transmit force along a projectile and simultaneously slide along the slanted interface of the wads, the stack thereby becoming wider and exerting an outwardly scrubbing force upon a neighboring inner surface of a bore of a firearm, in accordance with the present disclosure.

FIG. 19 illustrates in perspective view an alternative embodiment for a stack of cleaning materials, with two opposing slant-cut fibrous wads being configured to transmit force along a projectile and simultaneously slide along the slanted interface of the wads, the stack thereby becoming wider and exerting an outwardly scrubbing force upon a neighboring inner surface of a bore of a firearm. Stack 400 is illustrated including two fibrous wads 410 and 420 being configured with mating slanted surfaces. When combined, wads 410 and 420 create a substantially cylindrical stack of cleaning materials. slanted interface 415 is formed by the two slanted surfaces of wads 410 and 420.

Figure 20:
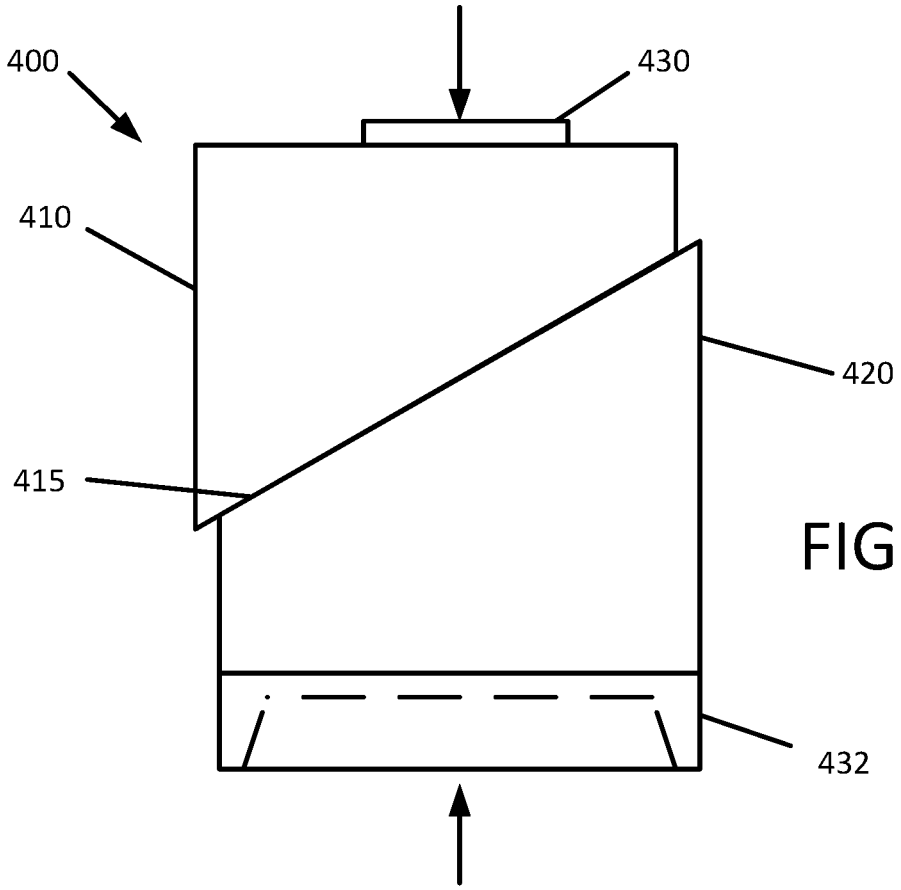
FIG. 20 illustrates in side view the embodiment of FIG. 19 in side view, with force being applied through the stack of cleaning materials and with the two wads sliding in relation to each other along the slanted interface between the wads, in accordance with the present disclosure.

FIG. 20 illustrates in side view the embodiment of FIG. 19 in side view, with force being applied through the stack of cleaning materials and with the two wads sliding in relation to each other along the slanted interface between the wads. Stack 400 is illustrated including wads 410 and 420 and slanted interface 415. Bore forward disk 430 and bore rearward disk 432 are illustrated, with force being applied to each end of disks as would occur as a projectile were being forced down the bore of a firearm. In the embodiment of FIG. 20, the bore rearward disk 432 includes a charge cap configured to receive force directly from the propellant charge, with no separate disk apart from the charge cap being required. As the force is applied to wads 410 and 420, the wads shift along interface 415 such that the pads are horizontally displaced from their original positions. This makes stack 400 wider than it was originally, which enables wads 410 and 420 to expand and be pressed against the inside of the bore of the firearm being cleaned.

Wads 410 and 420 may be but need not be hollow, or wads 410 and 420 may include indentions upon the end surfaces to locate and stabilize the location of the bore forward and rearward disks.

Figure 21:
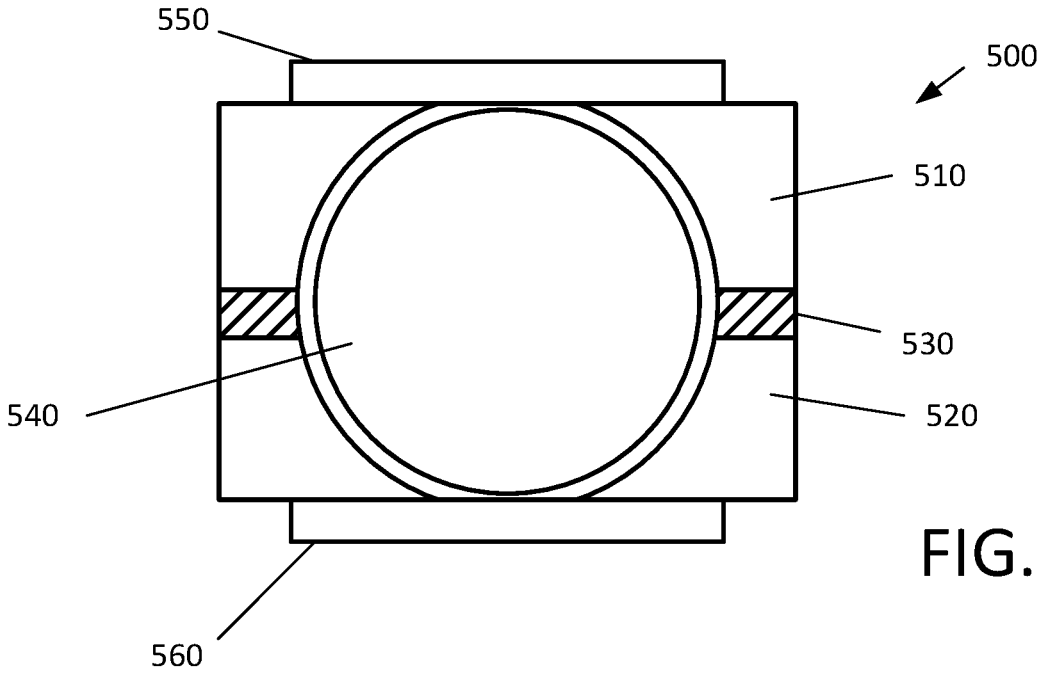
FIG. 21 illustrates in side cross-sectional view an additional alternative embodiment for a stack of cleaning materials, with a spherical compression core being surrounded by layered cleaning materials, wherein as force is applied to a bore forward disk and a bore rearward disk, the spherical compression core is flattened and provides an outward force upon surrounding cleaning materials, in accordance with the present disclosure.

FIG. 21 illustrates in side cross-sectional view an additional alternative embodiment for a stack of cleaning materials, with a spherical compression core being surrounded by layered cleaning materials, wherein as force is applied to a bore forward disk and a bore rearward disk, the spherical compression core is flattened and provides an outward force upon surrounding cleaning materials. Stack 500 is illustrated including a bore forward disk 550 and a bore rearward disk 560. Between disks 550 and 560, a spherical compression core 540 is illustrated. Spherical compression core 540 can include a rubberized or polymerized ball, dense foam, a spongy ball, or any other similar material that can be compressed to change shape with a compressive force. Cleaning materials are illustrated as exemplary fibrous pads 510 and 520 and wiper disk 530, which together form a substantially cylindrical outer surface with a core mating with the spherical outer shape of spherical compression core 540. When force is applied to disks 550 and 560, spherical compression core 540 compresses and becomes wider, thereby exerting outward force upon the cleaning materials, thereby pushing the cleaning materials against the inner surface of the bore of a firearm.

Figure 22:
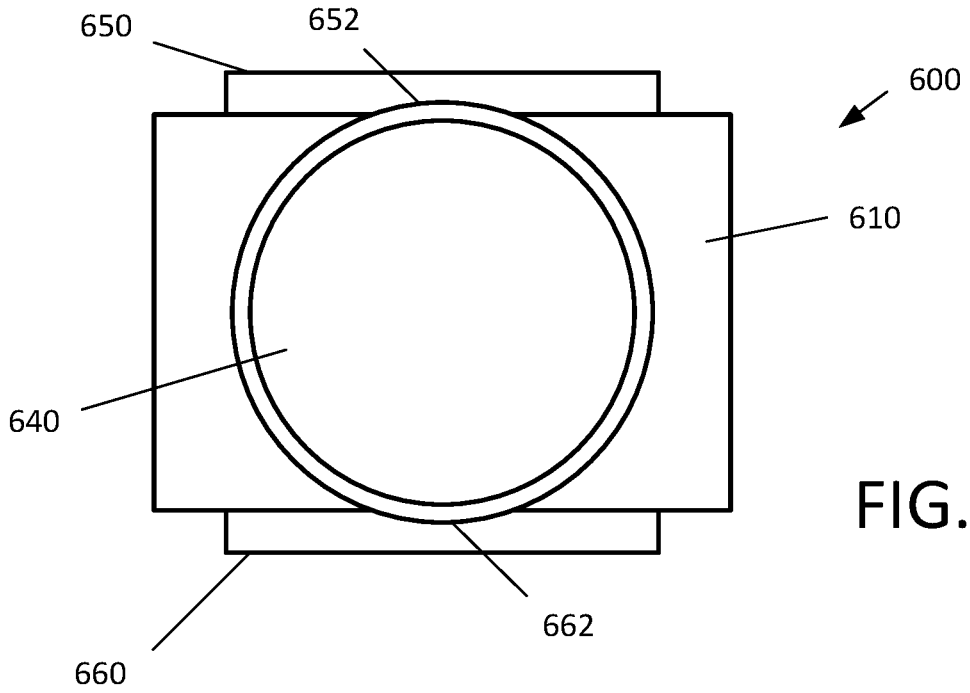
FIG. 22 illustrates in side cross-sectional view an additional alternative embodiment for a stack of cleaning materials, similar to the embodiment of FIG. 21 with a spherical compression core being surrounded by layered cleaning materials, wherein the spherical core and the cleaning materials are optionally all made of fibrous material, in accordance with the present disclosure.

FIG. 22 illustrates in side cross-sectional view an additional alternative embodiment for a stack of cleaning materials, similar to the embodiment of FIG. 21 with a spherical compression core being surrounded by layered cleaning materials, wherein the spherical core and the cleaning materials are optionally all made of fibrous material. Stack 600 is illustrated including a bore forward disk 650 and a bore rearward disk 660. Spherical compression core 640 is illustrated surrounded by cleaning materials 610, both of which are constructed of fibrous materials. In one embodiment, spherical compression core 640 can be constructed with a more dense fibrous material or a fibrous material with a higher durometer rating, such that when spherical compression core 640 is squeezed, it tends to be able to push the less dense material of cleaning material 610 out of the way (outwardly horizontally, so as to exert cleaning pressure against the inside of the bore of a firearm.) Disks 650 and 660 can each include an optional indentation 652 and 662, respectively, to help in locating to and stabilizing the spherical compression core 640.

The embodiments of FIGS. 19-22 all include stacks of cleaning materials that tend to push horizontally outwardly when a compressive force is applied to a top and a bottom of the stack. All of the cleaning materials of FIGS. 19 and 22, when receiving such a compressive force, transmit at least portion of the force through the stack of materials.

Figure 23:
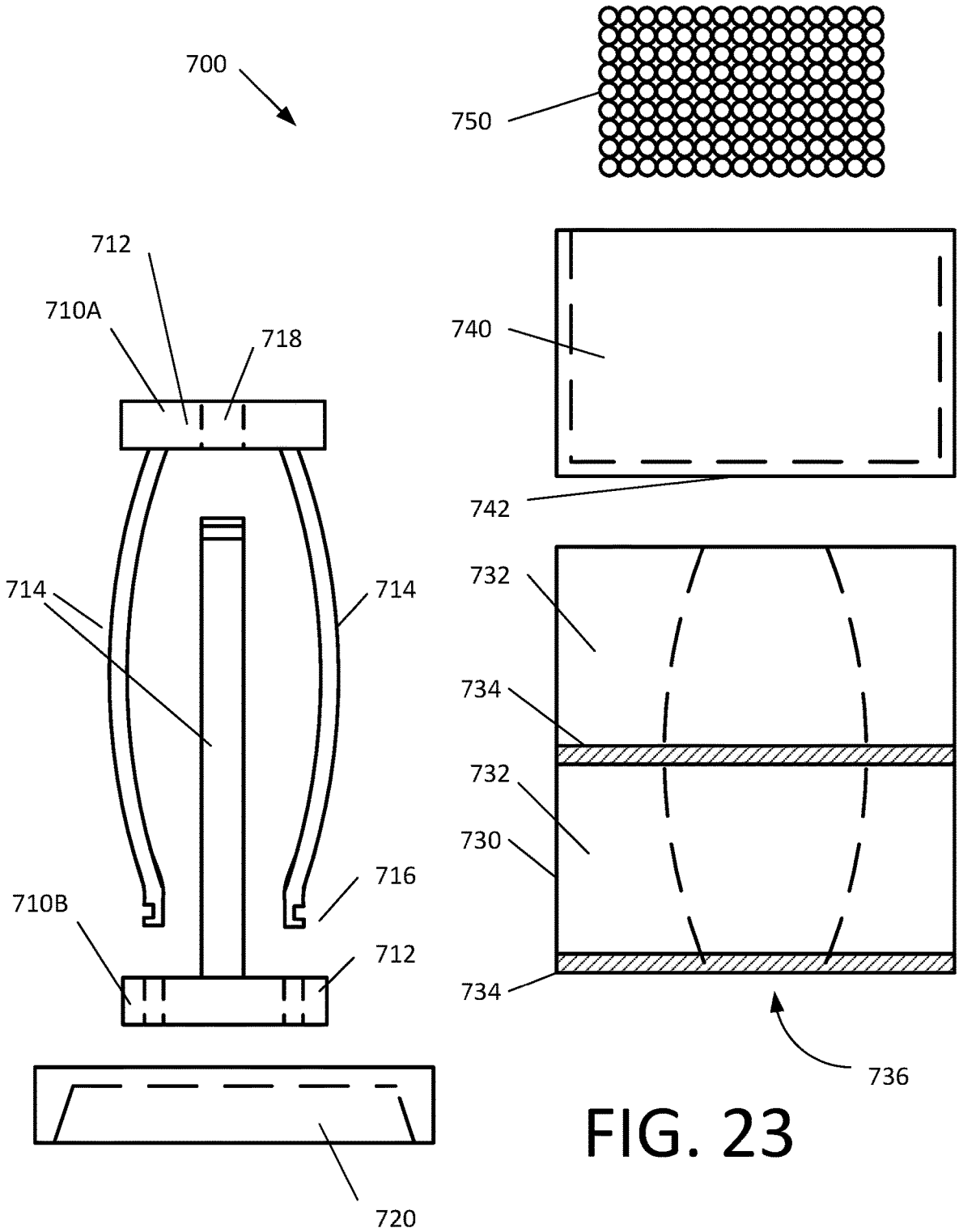
FIG. 23 illustrates an alternative exemplary embodiment of the bore cleaning device of FIG. 1 in side view with components of the device disassembled for illustration, in accordance with the present disclosure.

FIG. 23 illustrates an alternative exemplary embodiment of the bore cleaning device of FIG. 1 in side view with components of the device disassembled for illustration. Device 700 is illustrated including a two piece frame including upper frame portion 710A and lower frame portion 710B. Device 700 further includes lower charge cap 720, stack of cleaning materials 730, fibrous cup 740, and dense, granular material 750.

Each of frame portion 710A and 710B include a disk portion 712 and curved legs 714 configured to bend and provide an outward force upon stack of cleaning materials 730 as device 700 is being propelled down the bore of a firearm. Each of curved legs 714 includes a snapping attachment notch 716 configured to be snapped into a mating cavity 718 in the opposing disk portion 712. Legs 714 and cavities 718 are arranged such that the assembled frame includes four legs spaced at 90 degree intervals around the frame. It will be appreciated that similar frames could be created with two, three, five, or six legs. Portions 710A and 710B are illustrated as symmetrical portions, but they need not be symmetrical. For example, lower charge cap 720 could be attached and formed integrally with disk 712 of lower frame portion 710B.

Stack of cleaning materials 730 can include one to several types and sections of cleaning material. In the exemplary embodiment of FIG. 23, stack 730 includes two fibrous cylindrically shaped pads 732 and rubberized wiper disks 734. Stack 730 is configured to be wrapped around or installed around legs 714 and include a central cavity 736 configured to receive legs 714 therewithin.

Fibrous cup 740 is configured to receive dense material 750 which can include small spheres, small particles, dense metallic paste, or other similar materials. Cup 740 includes a bottom surface 742 with at least one hole through which a leg or legs of the frame can extend therethrough, such that a bore forward disk 712 of the frame can be within cup 740 when device 700 is assembled.

Figure 24:
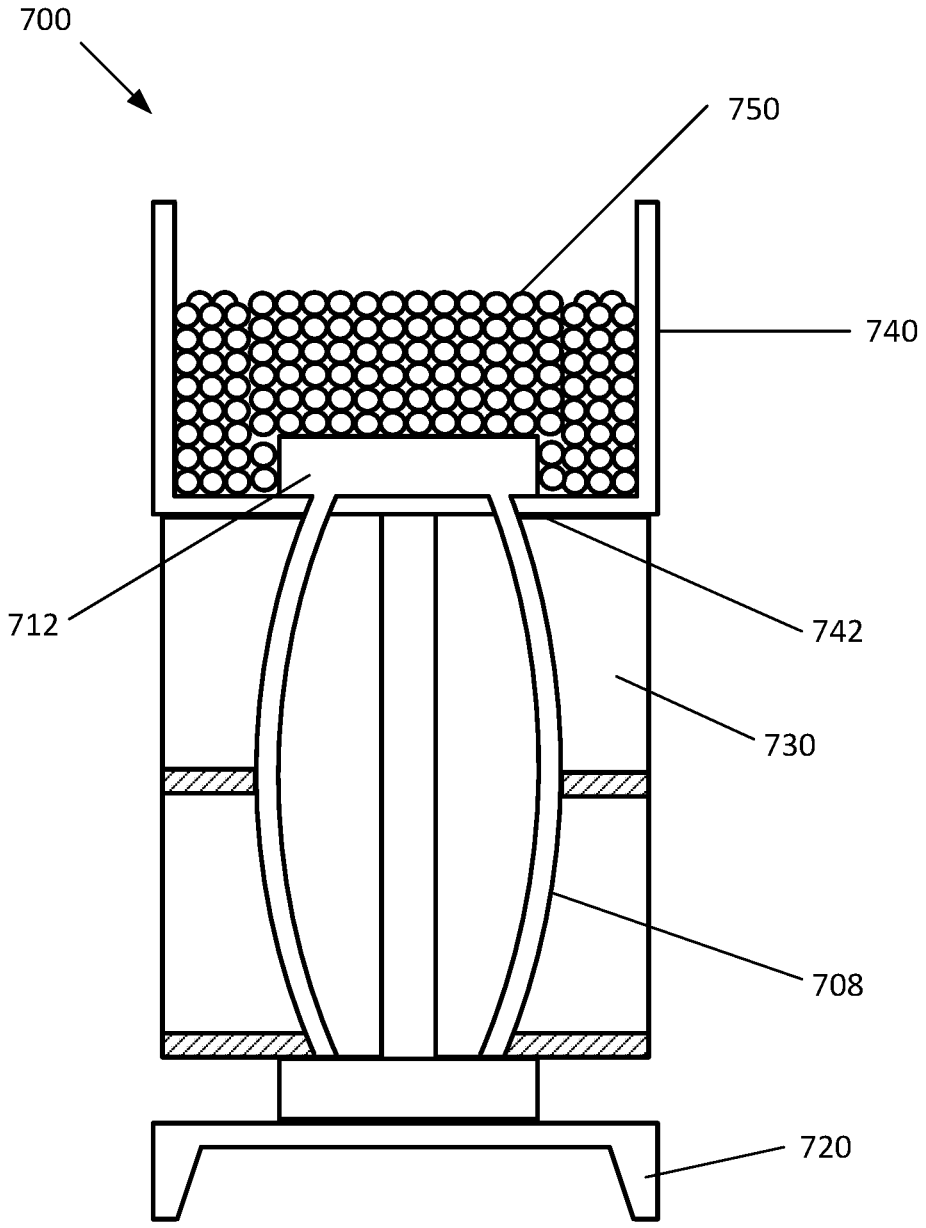
FIG. 24 illustrates the device of FIG. 23 in side sectional view with the components assembled, in accordance with the present disclosure.

FIG. 24 illustrates the device of FIG. 23 in side sectional view with the components assembled. Device 700 is illustrated including frame 708 including the upper and lower frame portions of FIG. 23, lower charge cap 720, stack of cleaning materials 730, and fibrous cup 740 containing dense materials 750. Disk 712 on a bore forward side of frame 708 is installed within cup 740, with legs of the frame extending through bottom surface 742 of cup 740. Having disk 712 within cup 740 includes a number of benefits. For one, device 700 is easier to manufacture, with the stack of components of device 700 being held together in preparation for insertion into an external casing. Further, cap 712, as device 700 is being propelled down the bore of the firearm, pushes upward on dense material 750, thereby causing some portion of dense material 750 to shift sideways from the center of the device and put more pressure outwardly upon cup 740, thereby increasing the cleaning force applied upon the bore of the firearm.

Figure 25:
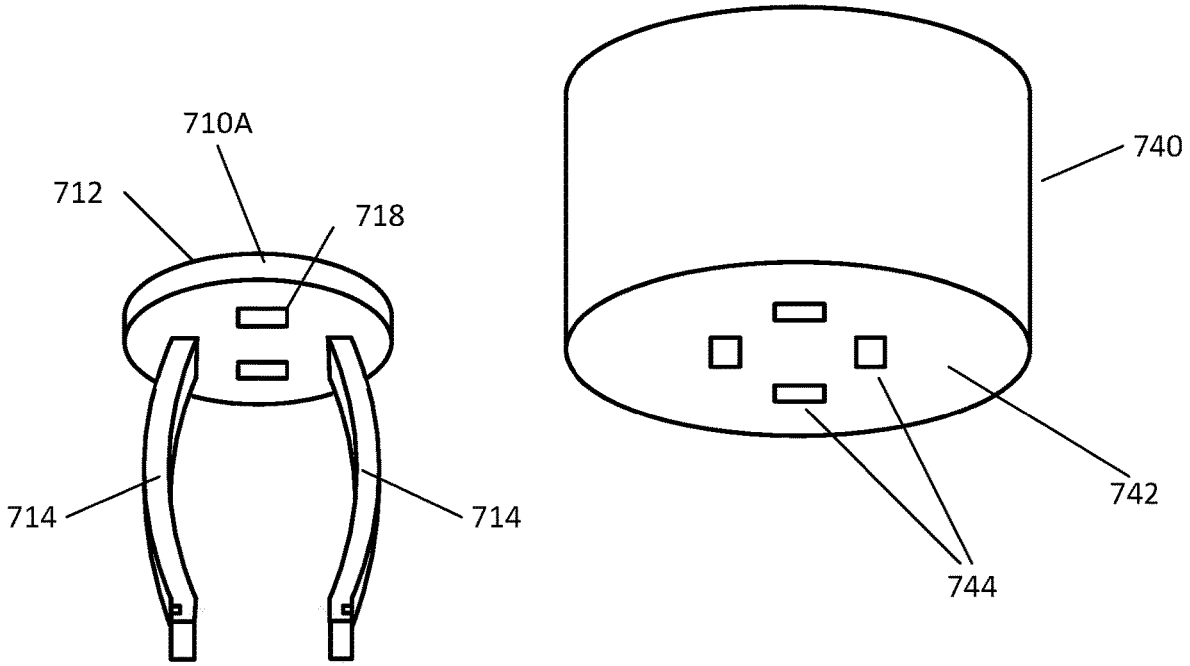
FIG. 25 illustrates the fibrous cup and the upper frame portion of the device of FIG. 23 disassembled in perspective view, in accordance with the present disclosure.

FIG. 25 illustrates the fibrous cup and the upper frame portion of the device of FIG. 23 disassembled in perspective view. Upper frame portion 710A is illustrated, including disk 712, legs 714, and cavities 718. Cup 740 is illustrated including bottom surface 742 with four holes 744 formed therein, with each of the four legs 714 of the frame being able to fit through one of holes 744, such that disk 712 can be within cup 740 while the rest of the frame is below cup 740.

Figure 26:
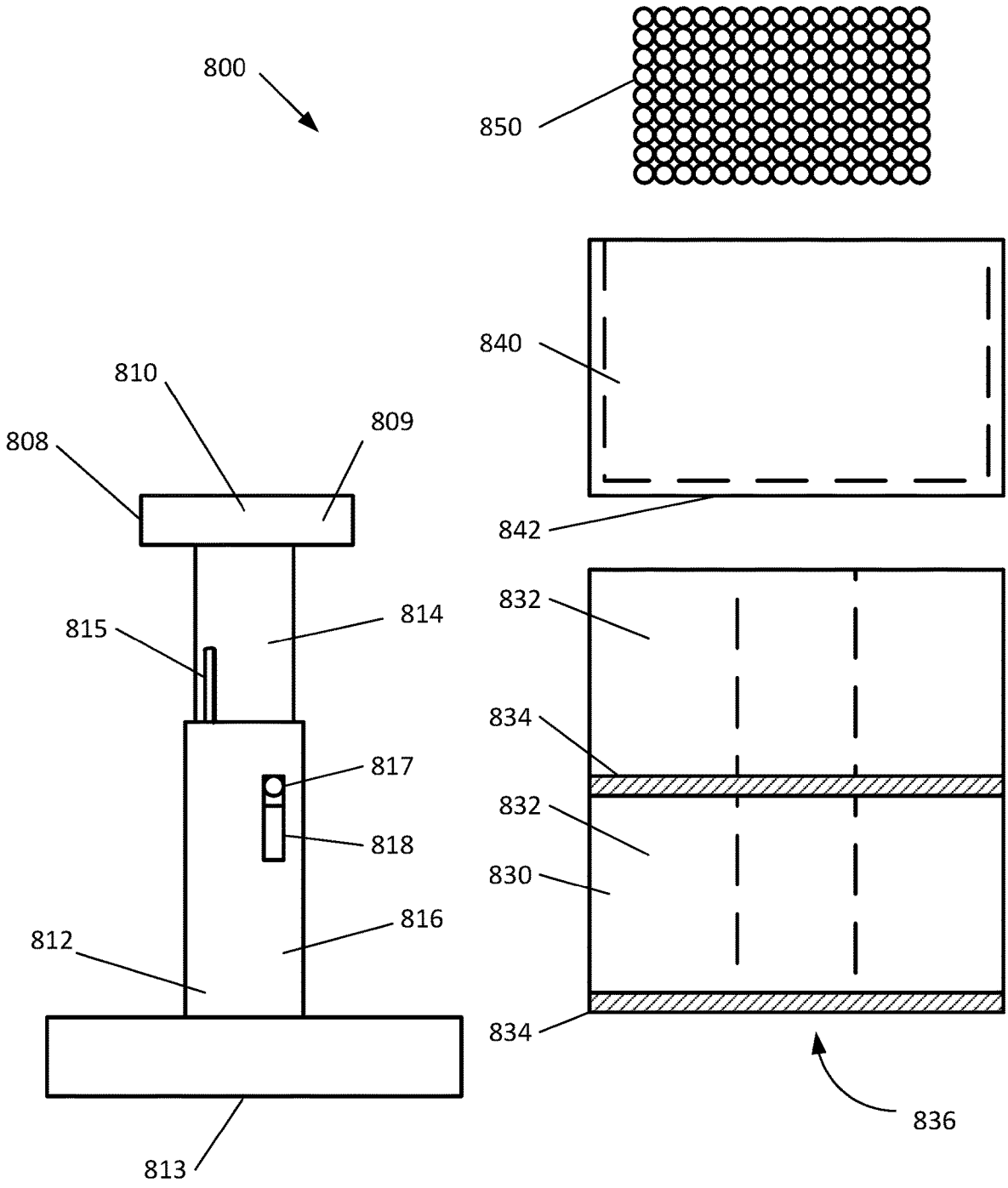
FIG. 26 illustrates an alternative exemplary embodiment of the bore cleaning device of FIG. 23 in side view with components of the device disassembled for illustration, in accordance with the present disclosure.

FIG. 26 illustrates an alternative exemplary embodiment of the bore cleaning device of FIG. 23 in side view with components of the device disassembled for illustration. Device 800 is illustrated including a two piece frame 808 including upper frame portion 810 and lower frame portion 812. Charge cap 813 is illustrated formed integrally with lower frame portion 812. Upper frame portion 810 includes bore forward disk 809 and round leg 814, which includes a flexing slot 815 cut along an end of leg 814 and a retention barb 817 formed upon an end of round leg 814. Lower frame portion 812 includes a round leg 816 and a barb channel 818. Leg 814 is configured to fit within a hollow center of leg 816, and barb 817 sits within channel 818, such that the two frame portions can slide axially against each other. Slot 815 enables an end of leg 814 to be compressed to fit within the center of leg 816 during assembly. Stack of cleaning materials 830, fibrous cup 840, and dense, granular material 850 are further illustrated. When assembled, stack 830 and cup 840 fit between disk 809 and cap 813, such that barb 817 is close to at at a top of slot 818, with the length of frame 808 being at or close to a maximum length. As compressive force is applied to device 800 between an exploding/expanding charge and the weight of dense material 850, compressive force applied to stack 830 compresses stack 830 and enables the frame to compress, with barb 817 moving toward a bottom channel 818. This compression of stack 830 squeezes the stack and causes the stack to expand radially outwardly against a bore of a firearm being cleaned. Further, dense material 850 compresses and pushes outwardly on cup 850 as disclosed herein.

Stack of cleaning materials 830 can include one to several types and sections of cleaning material. In the exemplary embodiment of FIG. 23, stack 830 includes two fibrous cylindrically shaped pads 832 and rubberized wiper disks 834. Stack 830 is configured to be wrapped around or installed around legs 814 and 816 and include a central cavity 836 configured to receive legs 714 and 816 therewithin.

Fibrous cup 840 is configured to receive dense material 850 which can include small spheres, small particles, dense metallic paste, or other similar materials. Cup 840 includes a bottom surface 842 with one round hole through which leg 814 can extend therethrough, such that a bore forward disk 809 of the frame can be within cup 840 when device 800 is assembled.

Figure 27:
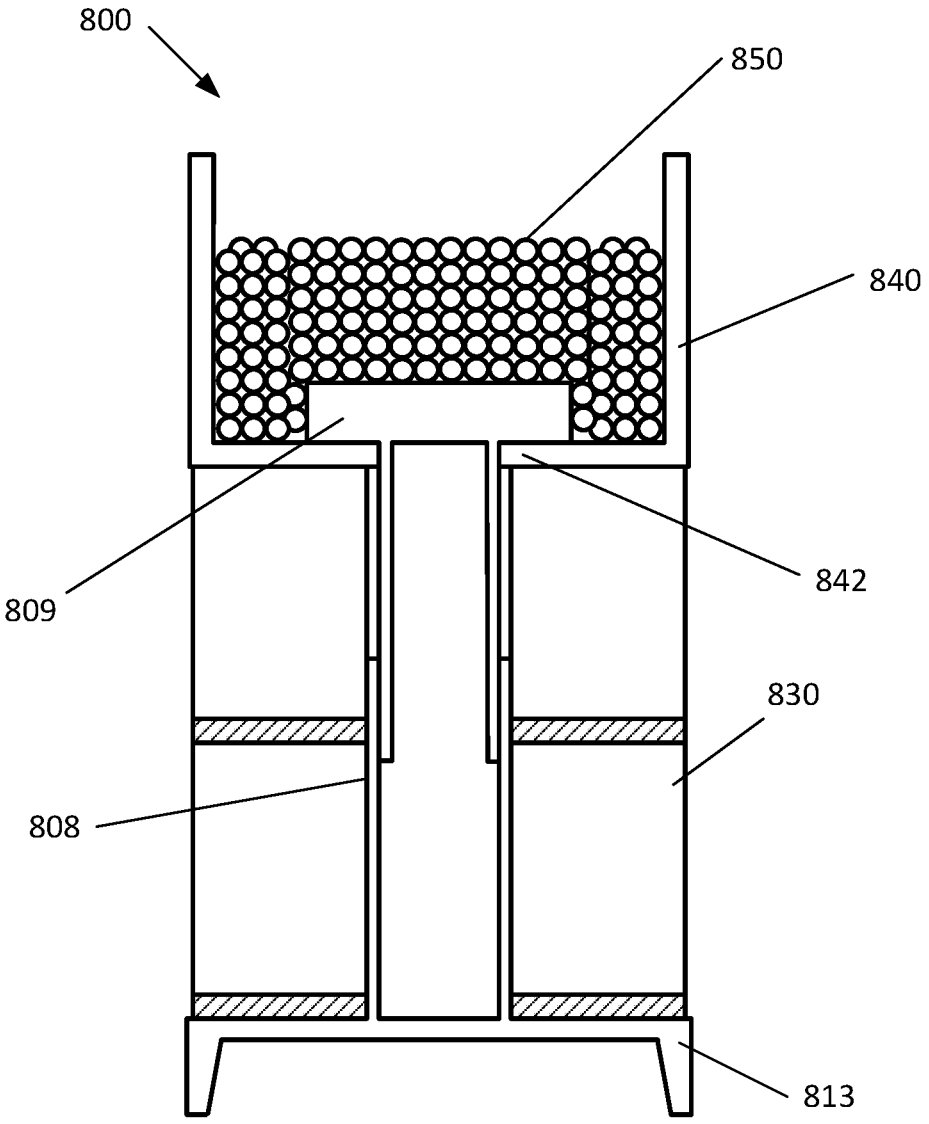
FIG. 27 illustrates the device of FIG. 23 in side sectional view with the components assembled, in accordance with the present disclosure.

FIG. 27 illustrates the device of FIG. 23 in side sectional view with the components assembled. Device 800 is illustrated including frame 808 including the upper and lower frame portions of FIG. 26, lower charge cap 813, stack of cleaning materials 830, and fibrous cup 840 containing dense materials 850. Disk 809 on a bore forward side of frame 808 is installed within cup 840, with the single leg of the frame extending through bottom surface 842 of cup 840.

Figure 28:
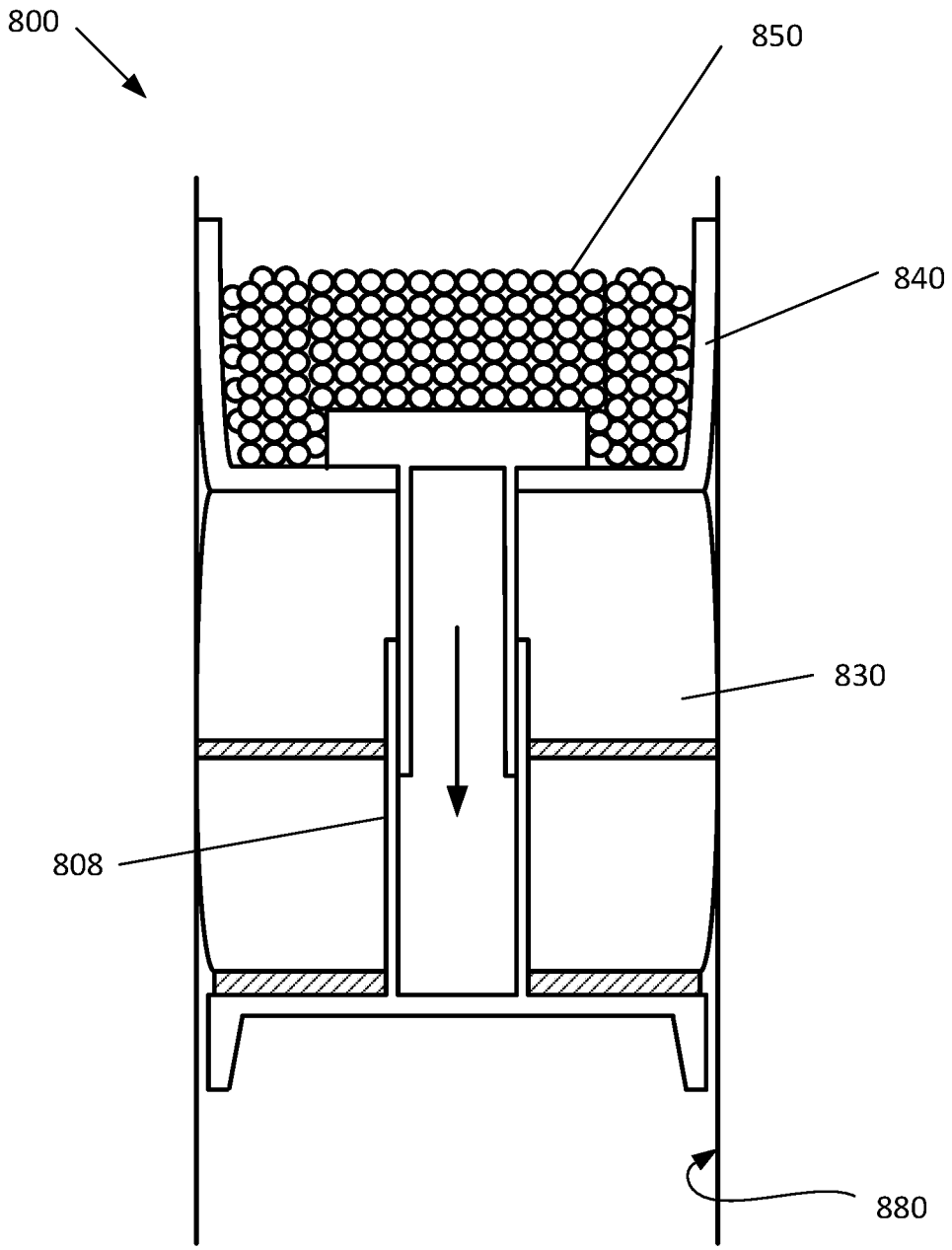
FIG. 28 illustrates the device of FIG. 26 in side sectional view, with the device illustrated being propelled down the bore of a firearm, in accordance with the present disclosure.

FIG. 28 illustrates the device of FIG. 26 in side sectional view, with the device illustrated being propelled down the bore of a firearm. Device 800 is illustrated including frame 808, stack of cleaning materials 830, fibrous cup 840, and dense material 850. Device 800 is illustrated in the process of being propelled down bore 880 of a firearm. Force from a propellant is pushing upwardly upon the charge cap of frame 808, and the mass of the device, and in particular, the mass of dense material 850, is resisting acceleration down the bore 880 due to inertia. As a result, there is a compressive force applied to frame 808 and stack 830, resulting in stack 830 pushing radially outward toward bore 880. In addition, dense materials 850 tend to flatten and push outwardly against bore 880. In this way, compressive force applied to device 800 is translated into an outward scrubbing force against the bore of the firearm.

Figure 29:
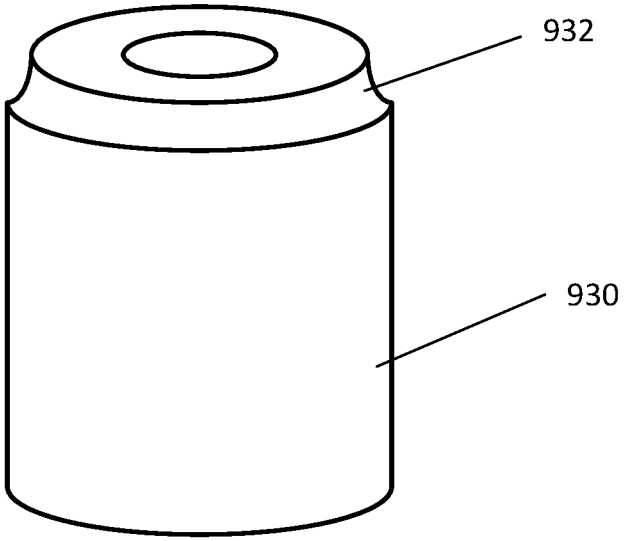
FIG. 29 illustrates an exemplary alternative embodiment of cleaning materials that can be used in combination with the exemplary devices of FIGS. 23 and 26, in accordance with the present disclosure.
Figure 30:
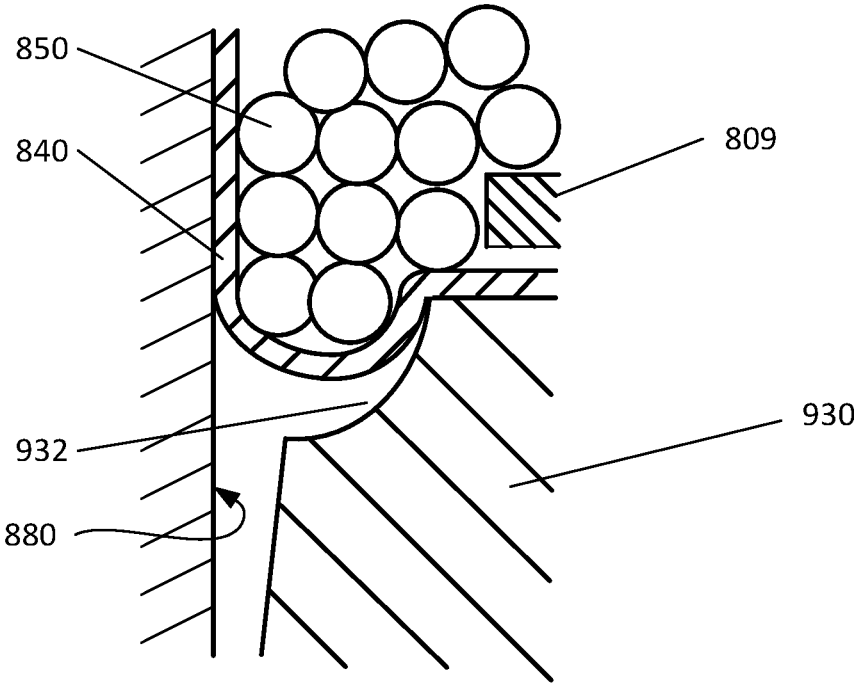
FIG. 30 illustrates in side sectional view the device of FIG. 26 with the cleaning materials of FIG. 29 installed thereto, with the device being propelled down the bore of a firearm, in accordance with the present disclosure.

FIG. 29 illustrates an exemplary alternative embodiment of cleaning materials that can be used in combination with the exemplary devices of FIGS. 23 and 26. Stack 930 is illustrating including a one piece pad of fibrous material. An optional channel 932 is formed along an upward, outward radius of the pad. FIG. 30 illustrates in side sectional view the device of FIG. 26 with the cleaning materials of FIG. 29 installed thereto, with the device being propelled down bore 880 of a firearm. As the device accelerates down the bore, inertial forces cause the dense material 850 to spread outward. Further resistance against the bore of the firearm causes cup 840 to deform backwardly as the device travels down the bore. Channel 932 of stack 930 is illustrated providing space for the cup 840 to deform backwardly into. Further, one can see that compressive force applied to the device, compressing stack 930, can cause disk 809 to separate from cup 840 and displace dense material 850, thereby causing even more of dense material 850 to press against the bore.

Figure 31:
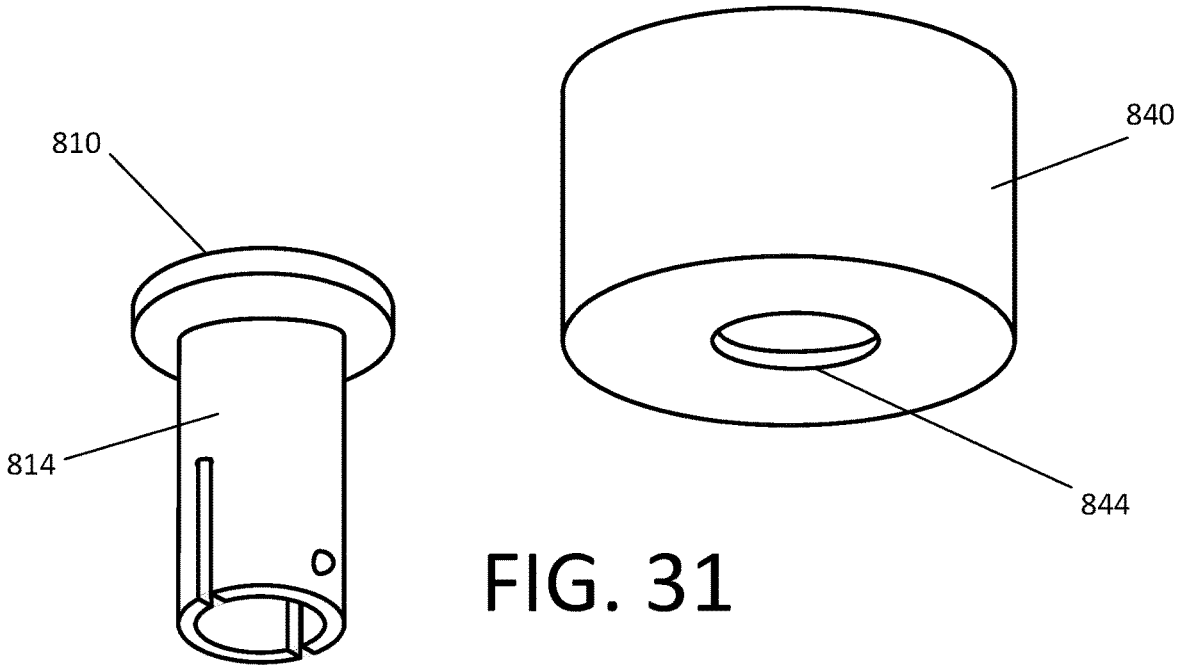
FIG. 31 illustrates the fibrous cup and the upper frame portion of the device of FIG. 26 disassembled in perspective view, in accordance with the present disclosure.
Figure 32:
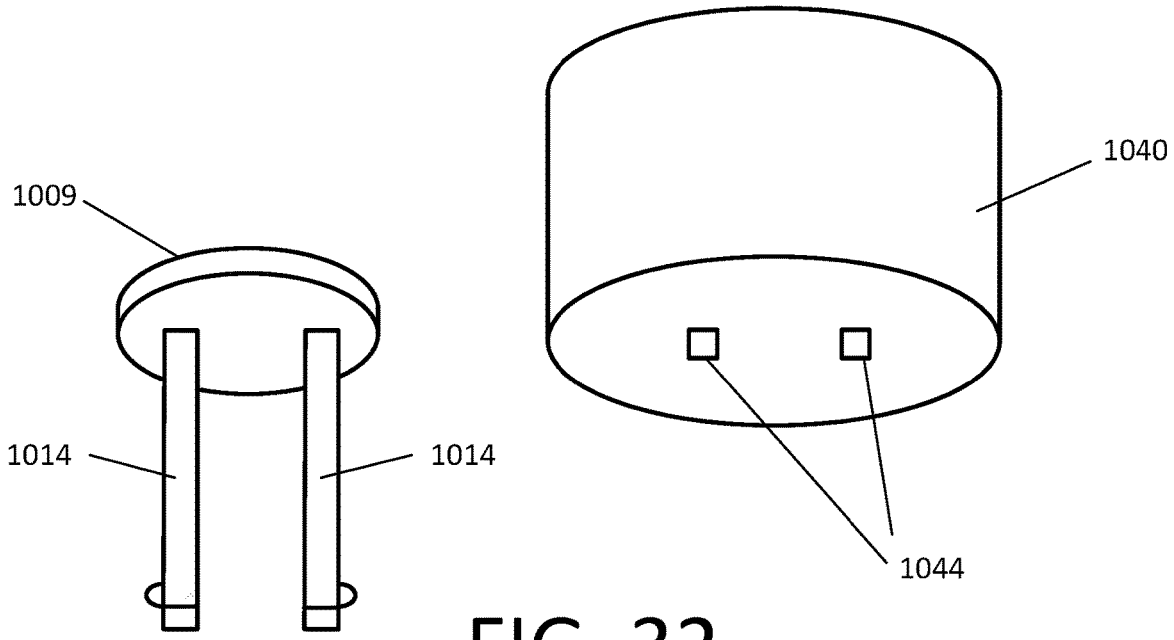
FIG. 32 illustrates an exemplary alternative embodiment of the fibrous cup and the upper frame portion of FIG. 31 disassembled in perspective view, in accordance with the present disclosure.

FIG. 31 illustrates the fibrous cup and the upper frame portion of the device of FIG. 26 disassembled in perspective view. Upper frame portion 810 is illustrated, including a disk and leg 814. Cup 840 is illustrated including a bottom surface with hole 844 formed therein, with leg 814 of the frame being able to fit through hole 844, such that the disk of portion 810 can be within cup 840 while the rest of the frame is below cup 840. FIG. 32 illustrates an exemplary alternative embodiment of the fibrous cup and the upper frame portion of FIG. 31 disassembled in perspective view. Upper frame portion 1009 is illustrated including two straight legs 1014. Cup 1040 is illustrated with two holes 1044 being formed in a bottom surface of cup 1040, such that the legs 1014 can extend through holes 1044 and the disk of portion 1009 can be within cup 1040.

Figure 33:
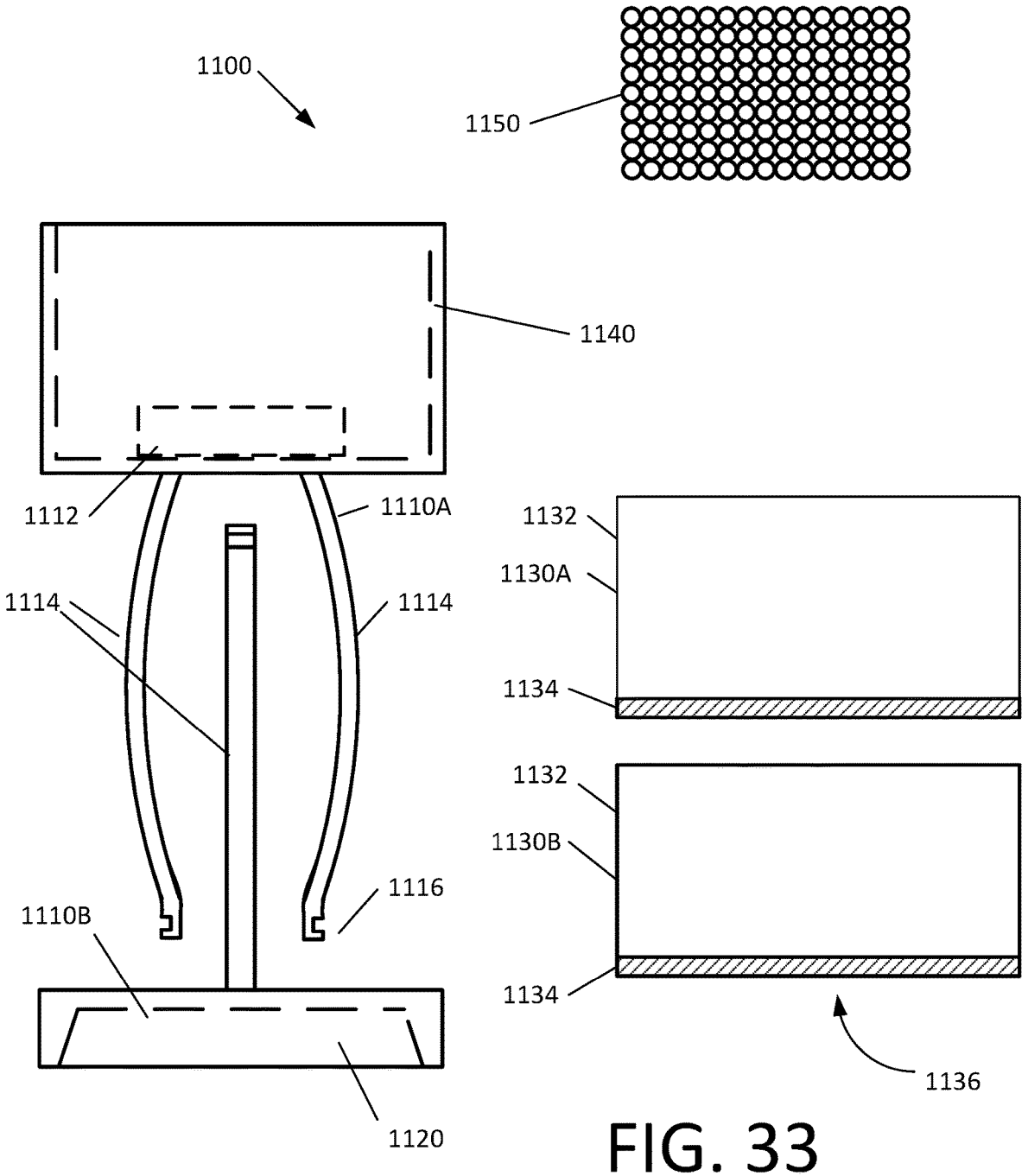
FIG. 33 illustrates an additional alternative exemplary embodiment of the bore cleaning device of FIG. 1 in side view with components of the device disassembled for illustration, in accordance with the present disclosure.

FIG. 33 illustrates an additional alternative exemplary embodiment of the bore cleaning device of FIG. 1 in side view with components of the device disassembled for illustration. Device 1100 is illustrated including a two piece frame including upper frame portion 1110A and lower frame portion 1110B. Lower frame portion 1110B includes an integrally formed lower charge cap 1120. Device 1100 further includes a first stack of cleaning materials 1130A, a second stack of cleaning materials 1130B, plastic cup 1140, and dense, granular material 1150. Device 1100 includes plastic/polymer upper frame portion 1110A, lower frame portion 1110B, and cup 1140. The plastic or polymer construction of these elements can be useful to ease manufacturing concerns. Plastic cup 1140 can include thin walls and/or flexible material such that the cup can deform radially outwards as the device is propelled down a bore of a firearm.

Each of frame portion 1110A and 1110B include a disk portion (the upper including disk 1112 and the lower including a top of charge cap 1120) and curved legs 1114 configured to bend and provide an outward force upon stacks of cleaning materials 1130A and 1130B as device 1100 is being propelled down the bore of a firearm. Each of curved legs 1114 includes a snapping attachment notch 1116 configured to be snapped into a mating cavity in the opposing disk portion. Legs 1114 and the mating cavities are arranged such that the assembled frame includes four legs spaced at 90 degree intervals around the frame. It will be appreciated that similar frames could be created with two, three, five, or six legs.

Stacks of cleaning materials 1130A and 1130B can include one to several types and sections of cleaning material. In the exemplary embodiment of FIG. 33, each of stacks 1130A and 1130B include a fibrous cylindrically shaped pad 1132 and a rubberized wiper disk 1134. Stacks 1130A and 1130B are configured to be wrapped around or installed around legs 1114 and include a central cavity 1136 configured to receive legs 1114 therewithin. Using two smaller stacks instead of one large stack can be useful to easing manufacturing concerns. Stacks 1130A and 1130B can in some embodiments each be glued together prior to assembly.

Plastic cup 1140 is configured to receive dense material 1150 which can include small spheres, small particles, dense metallic paste, or other similar materials. Cup 1140 includes a bottom surface with at least one hole through which a leg or legs of the frame can extend therethrough, such that a bore forward disk 1112 of the frame can be within cup 1140 when device 1100 is assembled.

Figure 34:
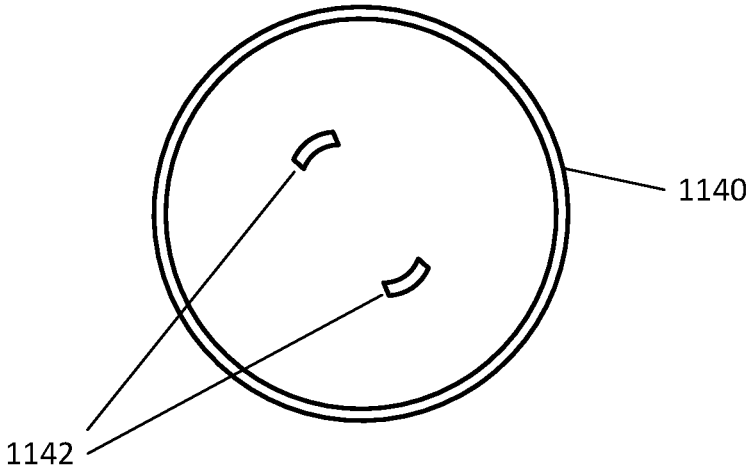
FIG. 34 illustrates the plastic cup of FIG. 33 from a top view, in accordance with the present disclosure.

FIG. 34 illustrates the plastic cup of FIG. 33 from a top view. Plastic cup 1140 is illustrated including two holes 1142 through which legs of frame portion 1110A of FIG. 33 can be fit to assemble the device.

The disclosure has described certain embodiments and modifications of those embodiments. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. An apparatus comprising a bore cleaning device configured to clean a bore of a firearm, the device comprising:
- a propellant providing a force to push the bore cleaning device down the bore of the firearm;
- a cup comprising at least one hole in a bottom surface of the cup;
- a dense material within the cup, wherein the dense material is configured to deform and press radially outwardly against the cup as the propellant provides propelling force to the dense material;
- a bore rearward charge cap; and
- a frame comprising:
  - a bore forward plate located within the cup; and
  - a frame leg connecting the bore rearward charge cap and the bore forward plate and passing through the hole in the bottom surface of the cup.

2. The apparatus of claim 1, wherein the dense material comprises one of metallic spheres, a dense granulated material, and a dense, viscous paste.

3. The apparatus of claim 1, wherein the frame further comprises a plurality of frame legs.

4. The apparatus of claim 1, further comprising a stack of cleaning materials wrapped around the frame; and
- wherein the frame further comprises a plurality of frame legs, wherein the frame legs are curved and are configured to bend and push radially outwardly against the stack of cleaning materials.

5. The apparatus of claim 1, further comprising a stack of cleaning materials wrapped around the frame; and
- wherein the frame is configured to compress and shorten in length, thereby squeezing the cleaning materials outwardly against the bore of the firearm.

6. The apparatus of claim 1, wherein the frame further comprises the bore rearward charge cap.

7. The apparatus of claim 1, wherein the frame further comprises:
- an upper frame portion; and
- a lower frame portion.

8. The apparatus of claim 7, wherein the upper frame portion comprises a first two frame legs;
- wherein the lower frame portion comprises a second two frame legs; and
- wherein the upper frame portion and the lower frame portion are configured to snap together.

9. The apparatus of claim 8, wherein the cup comprises four holes in the bottom surface.

10. The apparatus of claim 1, wherein the cup is a fibrous cup.

11. The apparatus of claim 10, further comprising a stack of cleaning materials installed around the frame; and
- wherein the stack of cleaning materials comprises a channel formed in the cleaning materials configured to permit the cup to deform backwardly into the channel as the apparatus moves down the bore of the firearm.

12. The apparatus of claim 1, wherein the cup is a plastic cup.

13. An apparatus comprising a bore cleaning device configured to clean a bore of a firearm, the device comprising:
- a propellant providing a force to push the bore cleaning device down the bore of the firearm;
- a fibrous cup comprising four holes in a bottom surface of the cup;
- a dense material within the fibrous cup, wherein the dense material is configured to deform and press radially outwardly against the cup as the propellant provides propelling force to the dense material;
- a bore rearward charge cap;
- a frame comprising:
  - an upper frame portion comprising:
    - a bore forward plate located within the fibrous cup; and
    - two frame legs and passing through two of the holes in the bottom surface of the cup; and
  - a lower frame portion comprising two additional frame legs; and
- a stack of cleaning materials installed around the frame;

wherein the two frame legs of the upper frame portion are configured to snap into cavities on the lower frame portion; and wherein the two additional frame legs of the lower frame portion are configured to snap into cavities on the upper frame portion.

14. An apparatus comprising a bore cleaning device configured to clean a bore of a firearm, the device comprising:

a propellant providing a force to push the bore cleaning device down the bore of the firearm;

a plastic cup comprising four holes in a bottom surface of the cup;

a dense material within the plastic cup, wherein the dense material is configured to deform and press radially outwardly against the cup as the propellant provides propelling force to the dense material;

a frame comprising:

an upper frame portion comprising:

a bore forward plate located within the plastic cup; and two frame legs and passing through two of the holes in the bottom surface of the cup; and a lower frame portion comprising:

two additional frame legs; and a bore rearward charge cap; and a stack of cleaning materials installed around the frame;

wherein the two frame legs of the upper frame portion are configured to snap into cavities on the lower frame portion; and wherein the two additional frame legs of the lower frame portion are configured to snap into cavities on the upper frame portion.

* * * * *